US007005570B2

(12) United States Patent
Nishitani et al.

(10) Patent No.: US 7,005,570 B2
(45) Date of Patent: Feb. 28, 2006

(54) TONE GENERATING APPARATUS, TONE GENERATING METHOD, AND PROGRAM FOR IMPLEMENTING THE METHOD

(75) Inventors: Yoshiki Nishitani, Hamakita (JP); Kenichi Miyazawa, Iwata-gun (JP); Eiko Kobayashi, Hamakita (JP); Katsuhiko Masuda, Fujieda (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/265,347

(22) Filed: Oct. 4, 2002

(65) Prior Publication Data

US 2003/0066412 A1 Apr. 10, 2003

(30) Foreign Application Priority Data

Oct. 4, 2001 (JP) ..... 2001-309069

(51) Int. Cl.
*G04B 5/00* (2006.01)
*G10H 7/00* (2006.01)

(52) U.S. Cl. ..... 84/609; 84/602; 84/649

(58) Field of Classification Search ..... 84/600–604, 84/609–610, 615–618, 626, 649–650, 653–656, 84/662, 723, 725–730, 737
See application file for complete search history.

(56) References Cited

U.S. PATENT DOCUMENTS

| | | | | |
|---|---|---|---|---|
| 4,194,426 | A * | 3/1980 | Deutsch et al. | 84/630 |
| 5,027,688 | A | 7/1991 | Suzuki et al. | |
| 5,046,394 | A | 9/1991 | Suzuki et al. | |
| 5,058,480 | A | 10/1991 | Suzuki et al. | |
| 5,177,311 | A | 1/1993 | Suzuki et al. | |
| 5,290,964 | A | 3/1994 | Hiyoshi et al. | |
| 5,296,642 | A * | 3/1994 | Konishi | 84/609 |
| 5,313,010 | A | 5/1994 | Matsushima et al. | |
| 5,512,703 | A | 4/1996 | Usa | |
| 5,585,584 | A | 12/1996 | Usa | |
| 5,648,627 | A | 7/1997 | Usa | |
| 5,663,514 | A | 9/1997 | Usa | |
| 6,479,741 | B1 * | 11/2002 | Morton et al. | 84/644 |
| 2001/0015123 | A1 * | 8/2001 | Nishitani et al. | 84/615 |

FOREIGN PATENT DOCUMENTS

JP 09-127937 5/1997

* cited by examiner

*Primary Examiner*—Marlon Fletcher
(74) *Attorney, Agent, or Firm*—Harness, Dickey & Pierce, PLC

(57) ABSTRACT

There is provided a tone generating apparatus and method that enables recording and reproduction of performance made by a performer without requiring any complicated operations. Musical tones generated from a musical instrument are detected, and tone data is stored in a storage device, and the tone data stored in the storage device is reproduced and at least one tone corresponding to the tone data is egenrated when no next musical tone is detected within a predetermined period of time after a musical tone is detected.

21 Claims, 16 Drawing Sheets

*FIG. 3*

TONE COLOR MANAGEMENT TABLE: TA

| TYPE OF PERCUSSION INSTRUMENT | ID |
|---|---|
| DRUM | C4 |
| TAMBOURINE | D5 |
| MARACAS | C2 |
| CASTANET | A5 |
| ⋮ | ⋮ |

TONE GENERATING APPARATUS, TONE GENERATING METHOD, AND PROGRAM FOR IMPLEMENTING THE METHOD

BACKGROUND OF THE INVENTION

1. Field of the Invention

The present invention relates to a tone generating apparatus and method that generates a variety of musical tones and the like, and more particularly to a tone generating apparatus and method that can be suitably used when a user performs a session, repeated practice, and the like, as well as a program for implementing the method.

2. Description of the Related Art

In recent years, with advancement of electronic musical instrument technology, electronic musical instruments having a variety of performance support functions have been put into practical use. For example, an automatic piano or the like is provided with a recording/reproducing function of recording and reproducing performance data generated by performance of the user, and the user playing the automatic piano listens to his or her performance by using the recording/reproducing function to recognize a portion of a musical piece that should be practiced repeatedly (e.g. a portion where the user makes a mistake frequently).

However, to use the recording/reproducing function, complicated operations are required such as an operation for recording his or her performance before playing a musical instrument, an operation for reproducing the recorded performance, and the like.

SUMMARY OF THE INVENTION

It is therefore an object of the present invention to provide a tone generating apparatus and method that enables recording and reproduction of performance made by a performer without requiring any complicated operations, as well as a program for implementing the method.

To attain the above object, in a first aspect of the present invention, there is provided a tone generating apparatus comprising a detecting device that detects musical tones generated from a musical instrument, and a storage device that stores tone data, and a tone generating device that reproduces the tone data stored in the storage device and generates at least one tone corresponding to the tone data when no next musical tone is detected by the detecting device within a predetermined period of time after a musical tone is detected by the detecting device.

In a preferred form of the first aspect, the tone generating apparatus further comprises a writing device that generates tone data from the musical tones detected by the detecting device and sequentially stores the generated tone data in the storage device, and wherein the tone generating device sequentially reproduces the tone data stored in the storage device to generate a phrase corresponding to the tone data when no next musical tone is detected by the detecting device within a predetermined period of time after a musical tone is detected by the detecting device.

More preferably, the writing device generates tone data for generating electronic tones by modifying at least one parameter selected from the group consisting of volume, tone color, and pitch of the musical tones detected by the detecting device, and sequentially stores the generated tone data in the storage device, and wherein the tone generating device reproduces the tone data stored in the storage device to generate a phrase composed of at least one electronic tone with the at least one parameter selected from the group consisting of volume, tone color, and pitch of the musical tones detected by the detecting device being modified, when no next musical tone is detected by the detecting device within the predetermined period of time after a musical tone is detected by the detecting device.

Also preferably, when a musical tone is detected by the detecting device while the phrase corresponding to the tone data is being generated, the tone generating device stops generating the phrase.

Also preferably, while the phrase corresponding to the tone data is being generated by the tone generating device, the detecting device stops detection of the musical tones.

A typical example of the musical instrument is a natural musical instrument.

To attain the above object, in a second aspect of the present invention, there is provided a tone generating apparatus comprising acquiring device that acquires an operating condition of an operating member that is operated by a user to generate a musical tone, a detecting device that refers to the operating condition of the operating member acquired by the acquiring device to determine whether the operating member lies in such an operating condition as to generate a musical tone, a storage device that stores tone data, and a tone generating device that, after the detecting device detects an operating condition in which the operating member generates a musical tone, reproduces the tone data stored in the storage device to generate a tone corresponding to the tone data when the detecting device does not detect an operation condition in which the operating member generates a next musical tone, within a predetermined period of time after the detection of the detecting device.

In a further preferred embodiment, the detecting device detects singing voices, the storage device stores singing voice data, and the tone generating device reproduces the singing voice data stored in the storage device and generates at least one tone corresponding to the singing voice data when no next singing voice is detected by the detecting device within a predetermined period of time after a singing voice is detected by the detecting device.

Preferably, the predetermined period of time can be set to a desired value by a user.

Preferably, the at least one tone corresponding to the tone data is at least one echo tone.

Alternatively, the at least one tone corresponding to the tone data is at least one effect tone.

According to the present invention, when the detecting device such as a microphone detects no next musical tone within a predetermined period of time after detecting a musical tone generated according to performance, the tone generating device reproduces tone data stored in the storage device. If the tone data stored in the storage device corresponds to the musical tone generated according to the performance, the tone generating device reproduces tones corresponding to the musical tone as echo tones upon the lapse of the predetermined period of time. In this way, the tone generating device automatically records and reproduces musical tones according to performance, and this enables the player to carry out recording, reproduction, and the like of his or her performance without any complicated operations.

To attain the above object, in a third aspect of the present invention, there is provided a tone generating method comprising the steps of detecting musical tones generated from a musical instrument, storing tone data in a storage device, and reproducing the tone data stored in the storage device and generating at least one tone corresponding to the tone data when no next musical tone is detected within a predetermined period of time after a musical tone is detected.

To attain the above object, in a fourth aspect of the present invention, there is provided a tone generating method comprising the steps of acquiring an operating condition of an operating member that is operated by a user to generate a musical tone, referring to the operating condition of the acquired operating member to determine whether the operating member lies in such an operating condition as to generate a musical tone, storing tone data in a storage device, and reproducing, after an operating condition is detected in which the operating member generates a musical tone, the tone data stored in the storage device to generate a tone corresponding to the tone data when an operation condition is not detected in which the operating member generates a next musical tone, within a predetermined period of time after the detection of the operating condition. The above and other objects, features, and advantages of the invention will become more apparent from the following detailed description taken in conjunction with the accompanying drawings.

To attain the above object, in a fifth aspect of the present invention, there is provided a computer-readable tone generating program comprising a detecting module for detecting musical tones, a storage module for storing tone data in a storage device, and a tone generating module for reproducing the tone data stored in the storage device and generates at least one tone corresponding to the tone data when no next musical tone is detected by the detecting module within a predetermined period of time after a musical tone is detected by the detecting module.

To attain the above object, in a sixth aspect of the present invention, there is provided a computer-readable tone generating program comprising an acquiring module for acquiring an operating condition of an operating member that is operated by a user to generate a musical tone, a detecting module for referring to the operating condition of the operating member acquired by the acquiring module to determine whether the operating member lies in such an operating condition as to generate a musical tone, a storage module for storing tone data in a storage device, and a tone generating module for, after the detecting module detects an operating condition in which the operating member generates a musical tone, reproducing the tone data stored in the storage device to generate a tone corresponding to the tone data when the detecting module does not detect an operation condition in which the operating member generates a next musical tone, within a predetermined period of time after the detection of the detecting module.

BRIEF DESCRIPTION OF THE DRAWINGS

FIG. 3 is a view showing a tone management table according to the first embodiment;

DETAILED DESCRIPTION OF THE PREFERRED EMBODIMENTS

A description will now be given of preferred embodiments of the present invention in which the invention is applied to a natural musical instrument, an electronic musical instrument, and a musical tone generation control system, with reference to the accompanying drawings. It is to be understood, however, that there is no intention to limit the invention to the following embodiments, but certain changes and modifications may be possible within the scope of the appended claims.

Figure 1:
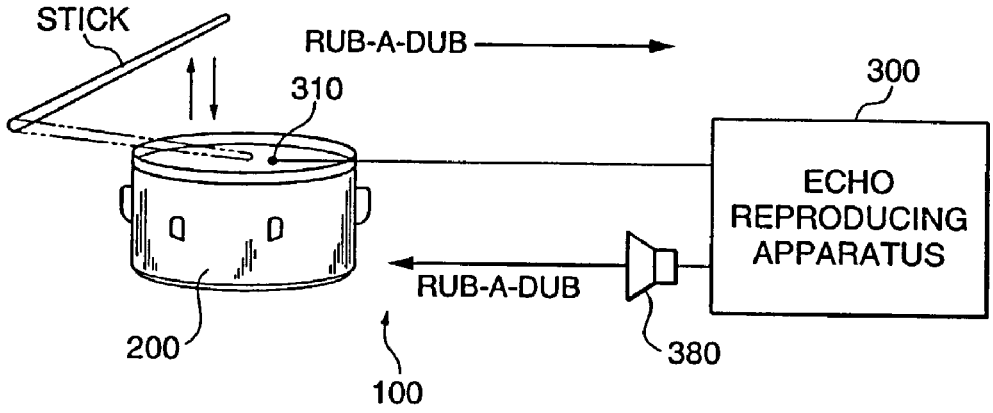
FIG. 1 is a view showing the arrangement of an echo reproducing system including an echo reproducing apparatus as a tone generating apparatus according to a first embodiment of the present invention.

FIG. 1 is a view showing the arrangement of an echo reproducing system including an echo reproducing apparatus as a tone generating apparatus according to a first embodiment of the present invention.

The echo reproducing system 100 is comprised of a percussion musical instrument 200 such as a drum that generates percussive tones according to the operation of a stick or the like, and an echo reproducing apparatus 300 that records the percussive tones generated by the percussion musical instrument 200 as tone data and then reproduces the recorded tone data in predetermined timing to generate echo tones corresponding to the percussive tones.

Figure 2:
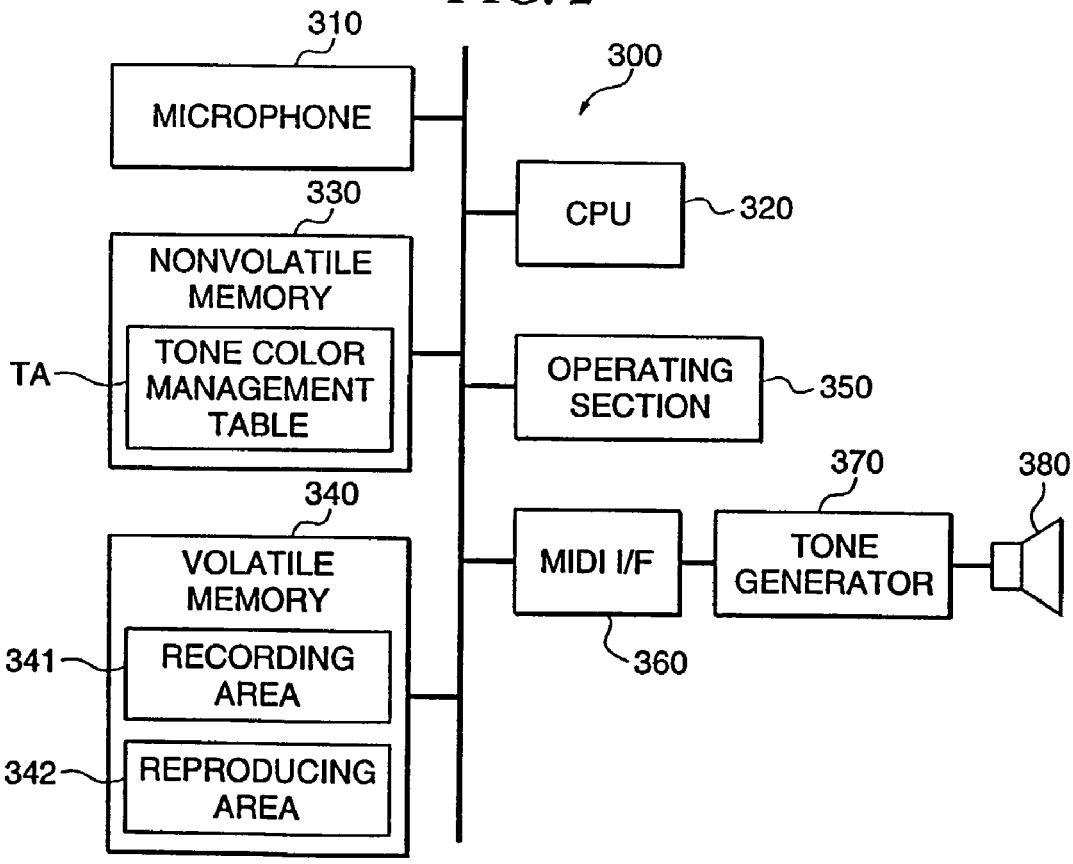
FIG. 2 is a block diagram showing the internal arrangement of the echo reproducing apparatus in FIG. 1.

FIG. 2 is a block diagram showing the internal arrangement of the echo reproducing apparatus 300 in FIG. 1.

A microphone 310, which is a small-sized nondirectional microphone, is provided at an end or the like of the percussion musical instrument 200, and converts percussive tones generated by the percussion musical instrument 200 into an electric signal and then supplies the electric signal to a CPU 320 via an A/D converter or the like, not shown.

The CPU 320 has a function of providing centralized control of component parts of the echo reproducing apparatus 300 by executing control programs or the like stored in a nonvolatile memory 330, a function of generating tone data conforming to the MIDI (Musical Instruments Digital Interface) standards (hereinafter referred to as "MIDI data") according to the electric signal supplied from the microphone 310 (described later in further detail), a function of providing control to generate echo tones in predetermined timing according to the MIDI data (described later in further detail), and other functions.

The nonvolatile memory 330 is comprised of a ROM (Read Only Memory), EEPROM (Electronically Erasable Programmable Read Only Memory), flash memory, FeRAM, MRAM, Polymer memory, or the like. The nonvolatile memory 330 stores a variety of control programs mentioned above and a tone color management table TA in FIG. 3. As shown in FIG. 3, types of percussion musical instruments and IDs for identifying tone colors of the percussion musical instruments are registered in correspondence to each other in the tone color management table TA. When playing the percussion musical instrument 200 while using the echo reproducing apparatus 300, the player operates an operating section 350 to select the type of the percussion musical instrument 200. Therefore, echoes are reproduced in a tone color of the selected percussion musical instrument 200, which will be described later in further detail.

Referring again to FIG. 2, a volatile memory 340 is comprised of a SRAM (Static Random Access Memory), a DRAM (Dynamic Random Access Memory), or the like. The volatile memory 340 is comprised of a recording area 341 where recording data generated by the CPU 320 is recorded, a reproducing area 342 where MIDI data transferred from the recording area 341 is recorded in reproducing echo tones, and the like.

The operating section 350 is comprised of a power ON/OFF switch, operating keys that are used for various settings relating to reproduction of echo tones (e.g. the above-mentioned setting of the tone color, and a setting of a sounding detection time as described later), and the like. The operating section 350 supplies the CPU 320 with a signal corresponding to the operation of the operating section 350 by the player who plays the percussion musical instrument 200.

A MIDI interface 360 supplies the MIDI data transferred from the reproducing area 342 to a tone generator 370 under the control of the CPU 320.

The tone generator 370 is comprised of a tone generating LSI or the like, and generates a musical tone signal according to the MIDI data supplied through the MIDI interface 360 and outputs the generated musical tone signal to a speaker 380 via a D/A converter and an amplifier, not shown, to reproduce echo tones.

Figure 4:
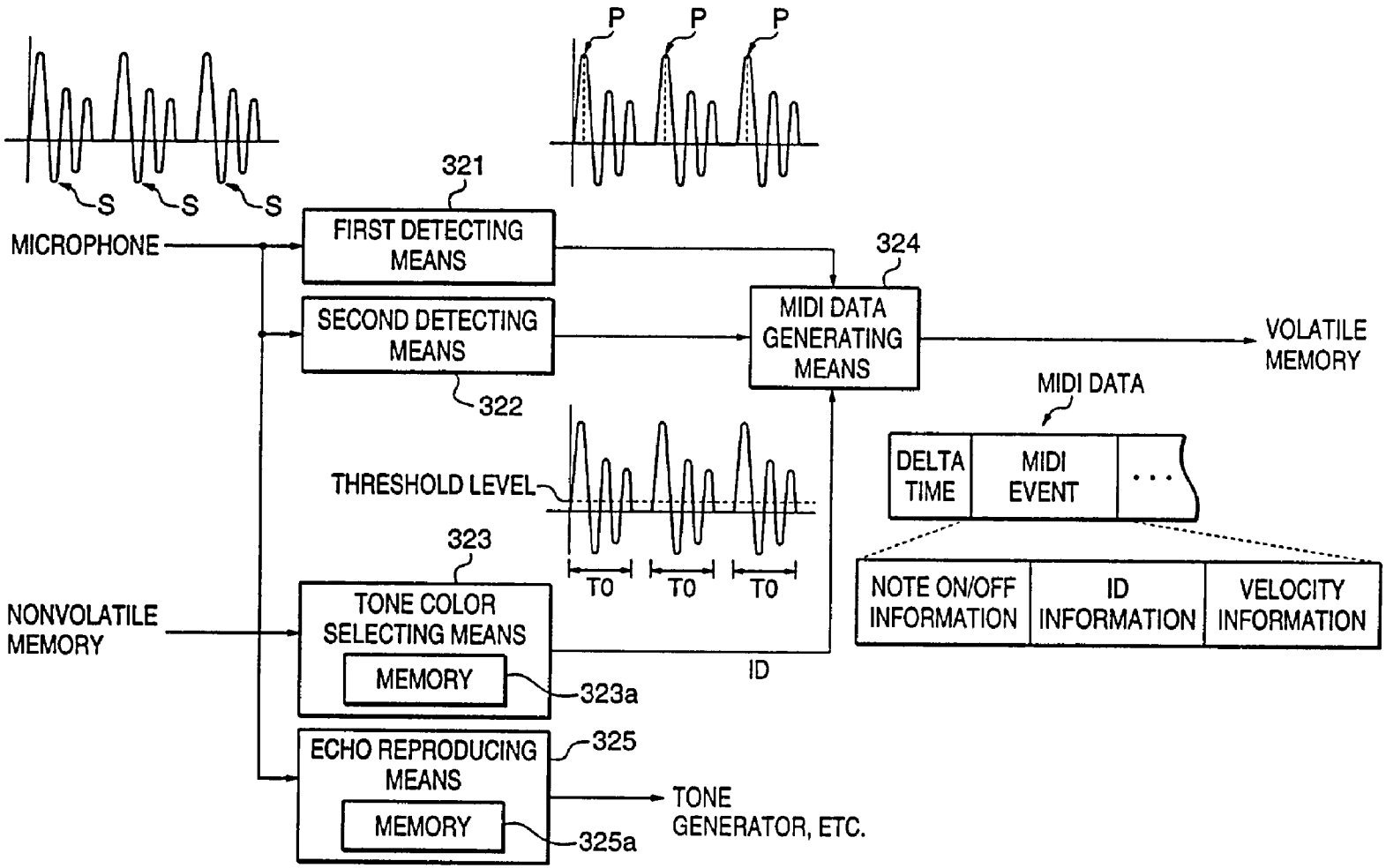
FIG. 4 is a view showing the functional arrangement of a CPU in FIG. 2.

FIG. 4 is a view showing the functional arrangement of the CPU 320 in FIG. 2.

A first detecting means 321 is for detecting the velocity of a percussive tone generated from the percussion musical instrument 200. The first detecting means 321 detects a peak value p or the like of the electric signal S outputted from the microphone 310, and outputs the detection result to a MIDI data generating means 324.

A second detecting means 322 is for detecting the length of a percussive tone generated from the percussion musical instrument 200. The second detecting means 322 detects a period of time T0 in which the level of the electric signal S outputted from the microphone 310 is in excess of a threshold, and outputs the detection result to the MIDI data generating means 324.

A tone color selecting means 323 is for selecting the type of the percussion musical instrument 200. The tone color selecting means 323 reads out an ID corresponding to a tone color (e.g. drum) selected by the player from the tone color management table TA (refer to FIG. 3), and stores the ID in a memory 323*a*. In response to an ID transfer request from the MIDI data generating means 324, the tone color selecting means 323 supplies the ID stored in the memory 323*a* to the MIDI data generating means 324.

The MIDI data generating means 324 generates MIDI data corresponding to the percussive tone based on the detection results supplied from the first detecting means 321 and the second detecting means 322, and the ID supplied from the tone color selecting means 323. The MIDI data is comprised of data representing the contents of performance called MIDI events and temporary data called delta time.

The MIDI events are each comprised of data such as note-on/note-off information indicative of whether a tone should be sounded or not, ID information specifying a tone color of an echo tone, and velocity information indicative of the velocity of a tone to be sounded. Specifically, the MIDI data is comprised of an instruction such as "Sound (note-on) a tone with an intensity 10 (velocity) in a drum tone color (ID)".

The delta time is information that indicates timing in which the MIDI event is executed (in detail, a period of time from the latest MIDI event). Upon execution of a certain MIDI event, the CPU 320 monitors a period of time elapsed from the start of the MIDI event, and when the elapsed time exceeds the delta time of the next MIDI event, the next MIDI event is executed.

The MIDI data generating means 324 sequentially stores the generated MIDI data in the recording area 341 of the volatile memory 340. It should be noted that the MIDI generating means 324 may change the value of the velocity contained in the MIDI data according to the detection results supplied from the first detecting means 321 and the second detecting means 322 without reflecting the detection results directly on the MIDI data.

An echo reproducing means 325 is for carrying out an echo reproducing process described later. The echo reproducing means 325 detects the start and stop of sounding by the percussion musical instrument 200 according to the electric signal S outputted from the microphone 310. If the stop of sounding by the percussion musical instrument 200 is detected, the echo reproducing means 325 shifts the MIDI data stored in the recording area 341 to the reproducing area 342 and supplies the MIDI data sequentially to the tone generator 370 to carry out echo reproduction.

A detailed description will now be given of an operation for detecting the stop of sounding. The echo reproducing means 325 is comprised of a memory 325*a* that stores the sounding detection time (e.g. 500 ms) set by the player. Upon start of the detection of sounding by the percussion musical instrument 200, the echo reproducing means 325 checks whether the next tone is sounded or not within the sounding detection time by referring to the sounding detection time stored in the memory 325*a*. If the next tone is sounded within the sounding detection time, the echo reproducing means 325 determines that the percussion musical instrument 200 continues sounding tones, and if the next tone is not sounded within the sounding detection time, the echo reproducing means 325 determines that the percussion musical instrument 200 has stopped sounding tones. Note that the operation of the echo reproducing means 325 will be described in detail in a later description of the operation of the present embodiment.

When playing the percussion musical instrument 200 while using the echo reproducing apparatus 300, the player operates the operating section 350 to apply power to the echo reproducing apparatus 350 and make various settings relating to the echo reproduction (e.g. the setting of the type of the percussion musical instrument 200 and the setting of the sounding detection time). It should be noted that although the player may set the sounding detection time and the like by operating the operating section 350, the detecting time may be set in the echo reproducing apparatus 300 in advance.

After the settings relating to the echo reproducing apparatus 300, the tone color selecting means 323 reads an ID corresponding to a tone color (e.g. drum tone color) selected by the player from the tone color management table TA (refer to FIG. 3) and stores the ID in the memory 323*a*, and the echo reproducing means 325 stores the sounding detection time set by the player in the memory 325*a* (refer to FIG. 4)

Figure 5:
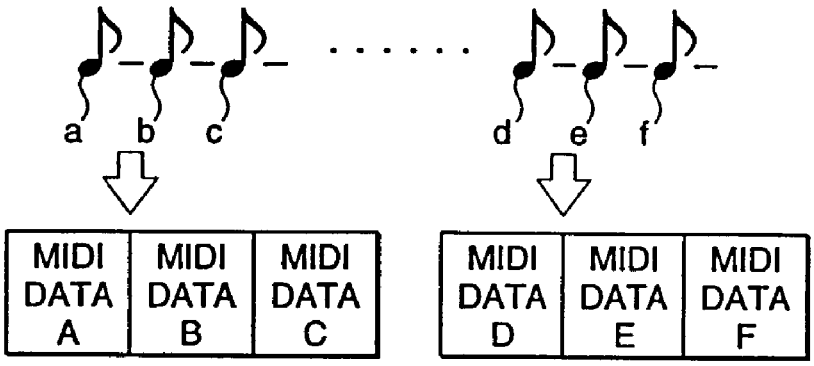
FIG. 5 is a view useful in explaining percussive tones generated by a percussion musical instrument in FIG. 1.

On the other hand, the player starts playing the percussion musical instrument 200 using sticks or the like. When the percussion musical instrument 200 generates percussive tones a, b, and c shown in FIG. 5, for example, the microphone 310 converts the percussive tones a, b, and c into an electric signal, and supplies the same to the CPU 320 via the A/D converter or the like.

Figure 6A:
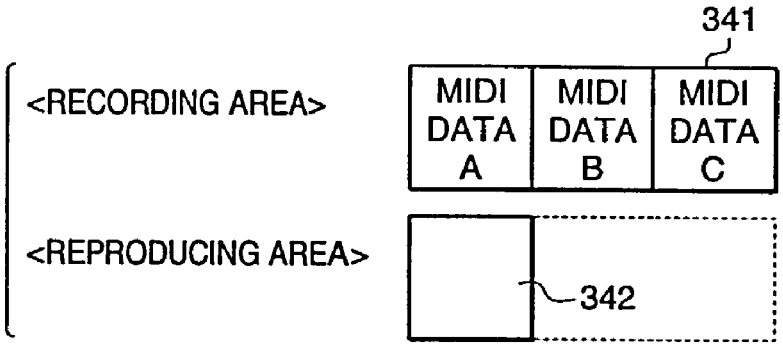
FIG. 6A is a view showing a first storage state of a volatile memory in FIG. 2.

The first detecting means 321 and the second detecting means 322 detect the velocity and the length, respectively, of the percussive tones generated from the percussion musical instrument 200, and output the detection results to the MIDI data generating means 324 (refer to FIG. 4). Upon receipt of the detection results from the first detecting means 321 and the second detecting means 322, the MIDI data generating means 324 reads out the IDs stored in the memory 323*a* of the tone color selecting means 323, and generates MIDI data A, B, and C corresponding to the percussive tones a, b, and c, respectively, and stores the MIDI data A, B, and C sequentially in the recording area 341 with a variable length (refer to FIG. 6A).

On the other hand, the echo reproducing means 325 carries out the echo reproducing process in response to the detection of sounding by the percussion musical instrument 200.

Figure 7:
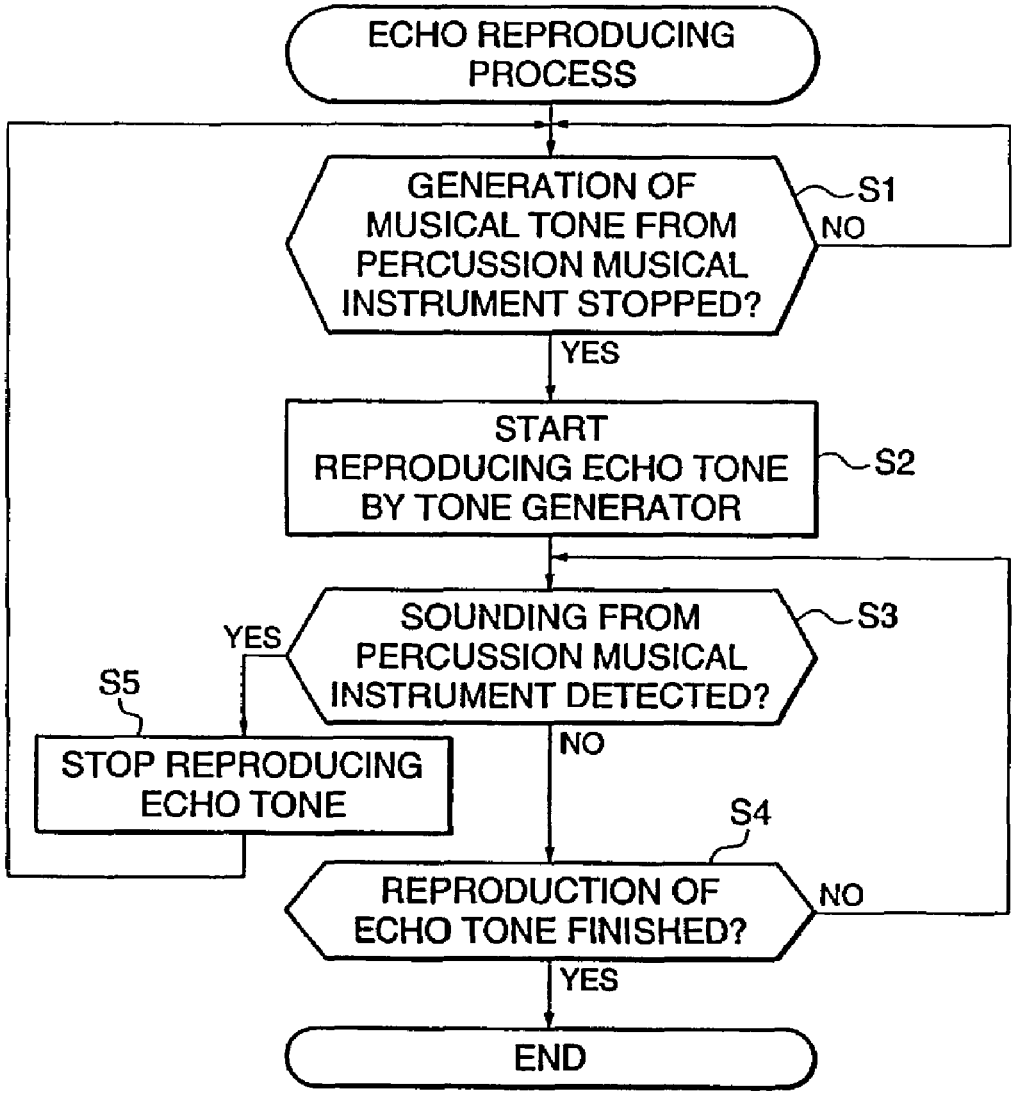
FIG. 7 is a flow chart showing an echo reproducing process according to the first embodiment.
Figure 8:
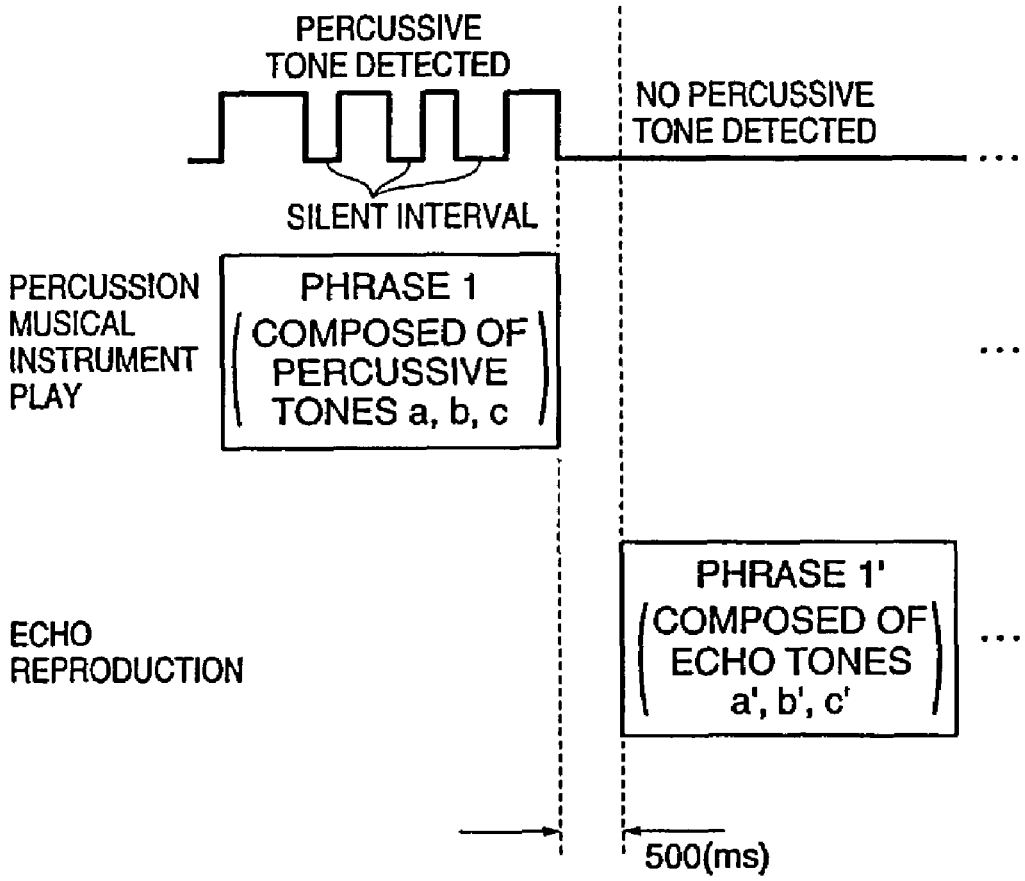
FIG. 8 is a view useful in explaining the echo reproducing process in FIG. 7.
Figure 9:
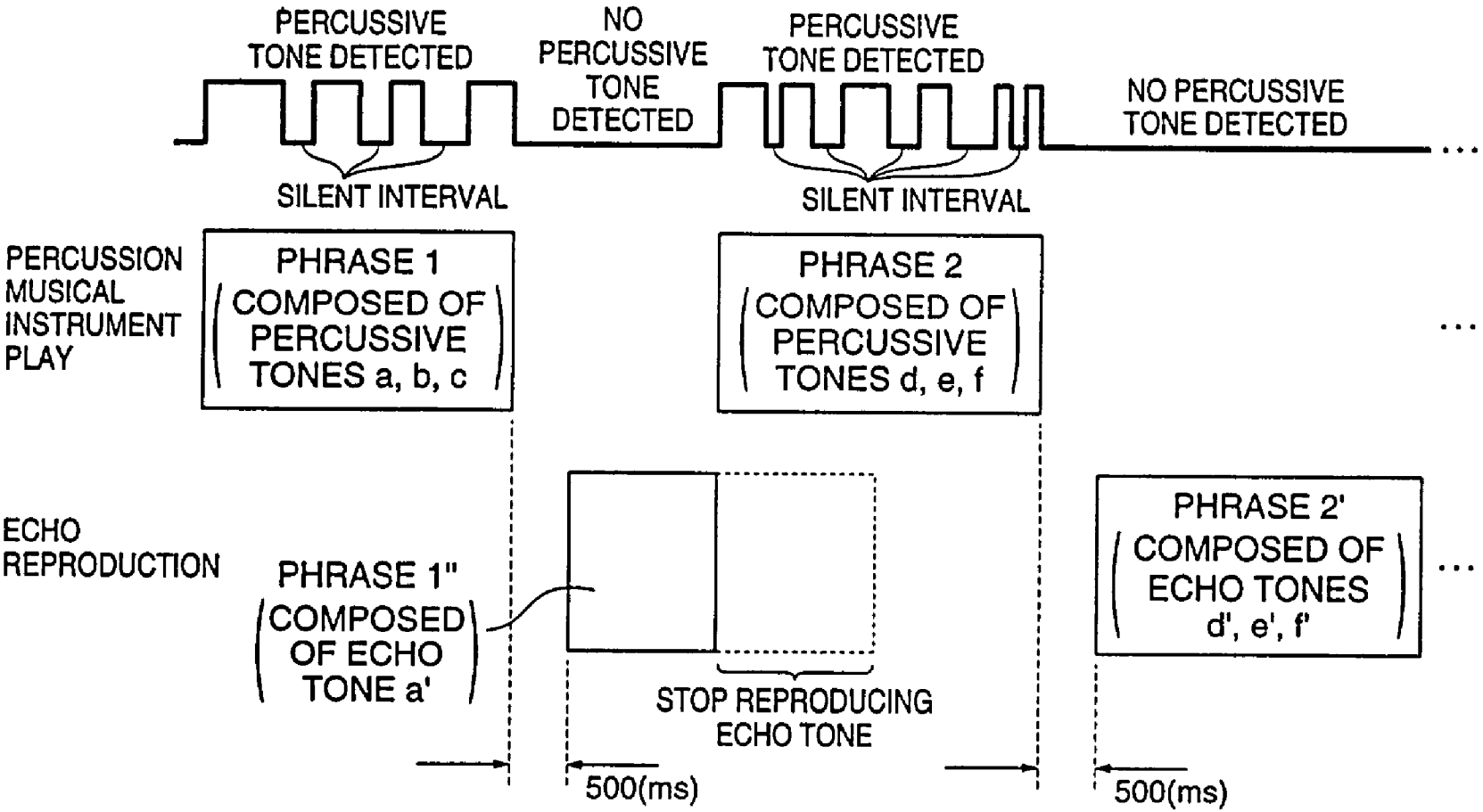
FIG. 9 is a view useful in explaining the echo reproducing process in FIG. 7.

FIG. 7 is a flow chart showing the echo reproducing process according to the present embodiment, and FIGS. 8 and 9 are views useful in explaining the echo reproducing process in FIG. 7.

As shown in FIG. 7, the echo reproducing means 325 checks whether or not the percussion musical instrument 200 has stopped sounding, i.e. whether or not the next tone has been sounded within the sounding detection time (step S1). If the next tone has been sounded within the sounding detection time (step S1; NO), the echo reproducing means 325 determines that the percussion musical instrument 200 continues sounding and then repeatedly executes the step S1.

Figure 6B:
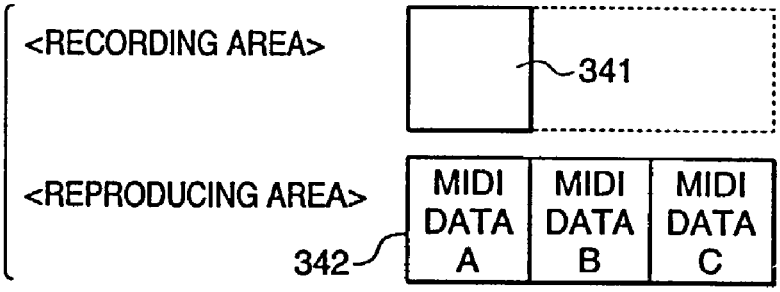
FIG. 6B is a view showing a second storage state of the volatile memory in FIG. 2.

On the other hand, if the next tone has not been sounded within the sounding detection time, the echo reproducing means 325 determines that the percussion musical instrument 200 has stopped sounding, and the process proceeds to a step S2. Specifically, as shown in FIG. 8, if the next tone is not detected within the sounding detection time (500 ms in FIG. 8) after a phrase 1 composed of the percussive tones a, b, and c is detected, the echo reproducing means 325 determines that the percussion musical instrument 200 has stopped sounding. In the step S2, the echo reproducing means 325 shifts the MIDI data A, B, and C stored in the recording area 341 to the reproducing area 342 (refer to FIG. 6B) so as to start reproduction of echo tones, and supplies the MIDI data A, B, and C sequentially to the tone generator 370 and gives the tone generator 370 an instruction for starting reproduction of echo tones.

Upon receipt of the MIDI data A, B, and C from the echo reproducing means 325 via the MIDI interface 360 and the instruction from the CPU 320, the tone generator 370 generates a musical tone signal from the MIDI data A, B, and C, and outputs the generated musical tone signal to the speaker 380 via the D/A converter, the amplifier, and the like, none of which is shown. Consequently, as shown in FIG. 8, a phrase 1' (composed of echo tones a', b', and c' corresponding to the percussive tones a, b, and c, respectively) corresponding to the phrase 1 is outputted sequentially from the speaker 380 upon the lapse of the sounding detection time of 500 ms after the detection of the phrase 1.

On the other hand, after the step S2, the echo reproducing means 325 determines whether the percussion musical instrument 200 has restarted sounding or not (step S3). If it is determined in the step S3 that the percussion musical instrument 200 has not restarted sounding (step S3; NO), the echo reproducing means 325 then determines whether the reproduction of the phrase 1' has been completed or not (step S4). It is determined in the step S4 that the reproduction of the phrase 1' has not been completed (step S4; NO), the process returns to the step S3 wherein the echo reproducing means 325 repeatedly executes the steps S3 and S4.

If it is determined in the step S4 that that the reproduction of the phrase 1' has been completed (i.e. the reproduction of the echo tones a', b', and c' has been completed) while executing the steps S3 and S4 (step S4; YES), the echo reproducing means 325 terminates the above described echo reproducing process.

On the other hand, if it is determined in the step S3 that the percussion musical instrument 200 has restarted sounding (step S3; YES), the process proceeds to a step S5 wherein the echo reproducing means 325 gives the tone generator 370 an instruction for stopping the echo reproduction. Specifically, if the percussion musical instrument 200 has restarted sounding in a state in which a phrase 1" composed only of the echo tone a' is reproduced and the echo tones b' and c' are not reproduced as shown in FIG. 9, the echo reproducing means 325 gives the tone generator 370 an instruction for stopping the echo reproduction. Consequently, as shown in FIG. 9, the echo tone a' corresponding to the percussive tone a is outputted from the speaker 380 upon the lapse of 500 ms after the detection of the phrase 1.

Figure 6C:
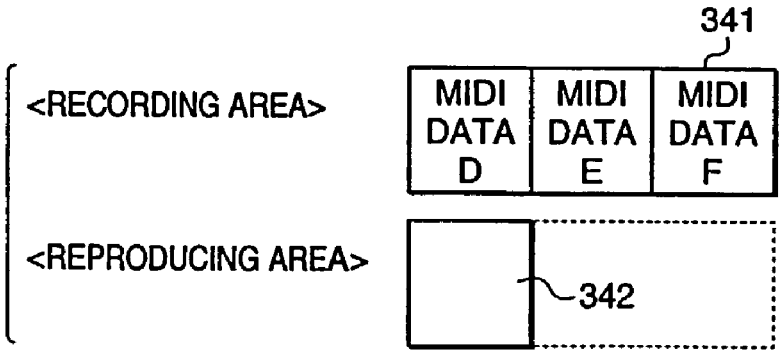
FIG. 6C is a view showing a third storage state of the volatile memory in FIG. 2.

In response to the restart of sounding (of percussive tones d, e, and f in this example) by the percussion musical instrument 200, the MIDI data generating means 324 generates MIDI data D, E, and F corresponding to the percussive tones d, e, and f, and stores the MIDI data D, E, and F sequentially in the recording area 341 with the variable length (refer to FIG. 6C). On the other hand, after the instruction for stopping the echo reproduction is given to the tone generator 370, the process returns to the step S1 wherein the echo reproducing means 325 determines whether the percussion musical instrument 200 has stopped sounding or not.

If it is determined in the step S1 that the percussion musical instrument 200 has stopped sounding, the process proceeds to the step S2 wherein the echo reproducing means 325 shifts the MIDI data D, E, and F stored in the recording area 341 to the reproducing area 342 so as to start the echo reproduction, and supplies the MIDI data D, E, and F sequentially to the tone generator 370 and gives the tone generator 370 an instruction for starting the echo reproduction. Consequently, as shown in FIG. 9, echo tones d', e', and f' corresponding to the percussive tones d, e, and f are sequentially outputted from the speaker 380. It should be noted that after the echo reproducing means 325 gives the tone generator 370 the instruction for starting the echo reproduction, the operation and the like of the echo reproducing means 325 are identical with those described above, and a description thereof is omitted herein.

As described above, if the percussion musical instrument 200 sounds percussive tones, the echo reproducing apparatus 300 according to the present embodiment sounds echo tones corresponding to the percussive tones upon the lapse of a predetermined period of time (i.e. the above-mentioned sounding detection time). Therefore, one player who plays the percussion musical instrument 200 can perform a session, which is ordinarily performed by a plurality of players.

Further, according to the present embodiment, immediately when the percussion musical instrument 200 starts sounding a percussive tone, the echo reproducing apparatus 300 starts recording the percussive tone. If the next percussive tone is not detected within the sounding detection time (e.g. 500 ms), the echo reproducing apparatus 300 determines that the percussion musical instrument 200 has stopped sounding and reproduces a percussive tone, which has been recorded up to the present time point, as an echo tone.

Specifically, since the echo reproducing apparatus 300 automatically carries out determinations for recording and reproduction of performance of the musical instrument 200, the player does not have to carry out any complicated operations for recording and reproducing the performance of the percussion musical instrument 200. Therefore, the player can perform repeated practice while listening to a predetermined part (e.g. a part where the player frequently makes a mistake) without any complicated operations for recording and reproducing his or her performance.

Further, according to the present embodiment, the echo reproducing apparatus 300 starts reproducing an echo tone and restarts detecting a percussive tone sounded from the percussion musical instrument 200 at the same time, and if the percussive tone is detected while the echo tone is being reproduced, the echo reproducing apparatus 300 stops reproducing the echo tone (refer to FIG. 9). Namely, in a case where a percussive tone is sounded from the percussion musical instrument 200 before the reproduction of an echo tone is completed, the percussive tone sounded from the percussion musical instrument 200 takes priority. This eliminates, for example, the problem that the player cannot listen to a tone performed by himself or herself (e.g. a percussive tone sounded from the percussion musical instrument 200 according to the operation by the player) due to an echo tone sounded from the echo reproducing apparatus 300.

It should be understood that the present invention is not limited to the embodiment disclosed, but various variations of the above described embodiment may be possible without departing from the spirits of the present invention, including variations as described below, for example.

Although in the above described first embodiment, the drum is used as the percussion musical instrument 200, the present invention may be applied to all kinds of percussion musical instruments such as tympani, cymbal, maracas, and castanets. Further, the present invention may also be applied to all kinds of natural musical instruments that generate tones peculiar to themselves (hereinafter referred to as "natural musical tones) according to the operation by the player, e.g. claviers such as piano, stringed instruments such as violin, brass instruments such as trumpet, and woods such as clarinets.

Further, the echo reproducing apparatus 300 described above is applied to a variety of natural musical instruments, but may be used singly. For example, in a case where the user sings a certain song, the echo reproducing apparatus 300 detects and records a singing voice sounded by the user, and sounds an echo tone corresponding to the singing voice upon the lapse of a predetermined period of time (e.g. the above-mentioned sounding detection time). In this way, the echo reproducing apparatus 300 may be used singly.

Figure 10:
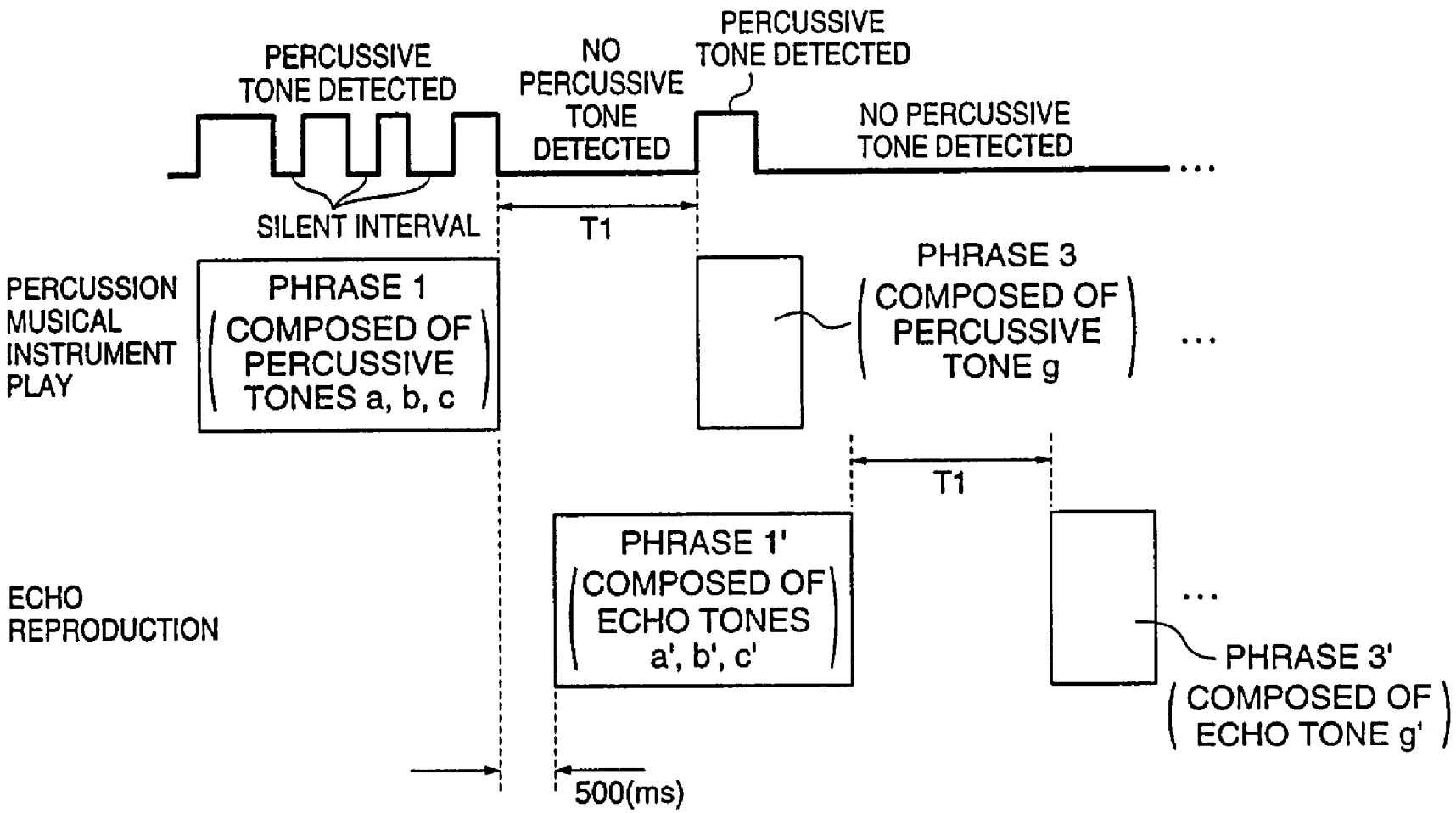
FIG. 10 is a view useful in explaining an echo reproducing process according to a first variation of the first embodiment.

Further, although as shown in FIG. 9, the echo reproducing apparatus 300 is configured to restart reproducing an echo tone and restart detecting a percussive tone sounded from the percussion musical instrument 200 at the same time, and to stop reproducing the echo tone if the percussive tone has been detected, the echo reproducing apparatus 300 may be configured not to stop reproducing the echo tone (refer to FIG. 10). In this case, an echo tone g' (phrase 3') corresponding to a percussive tone g (phrase 3) detected during the reproduction of the echo tones a', b', and c' (phrase 1') is only required to be reproduced upon the lapse of a period of time T1 after the reproduction of the phrase 1' is completed. It should be noted that a period of time required after the percussive tones a, b, and c (phrase 1) are detected and before the percussive tone g (phrase 3) is detected is measured using a timer or the like, not shown, and is set as the predetermined period of time T1, but the predetermined period of time T1 may be set in various ways according to the configuration, etc. of the echo reproducing apparatus 300.

Figure 11:
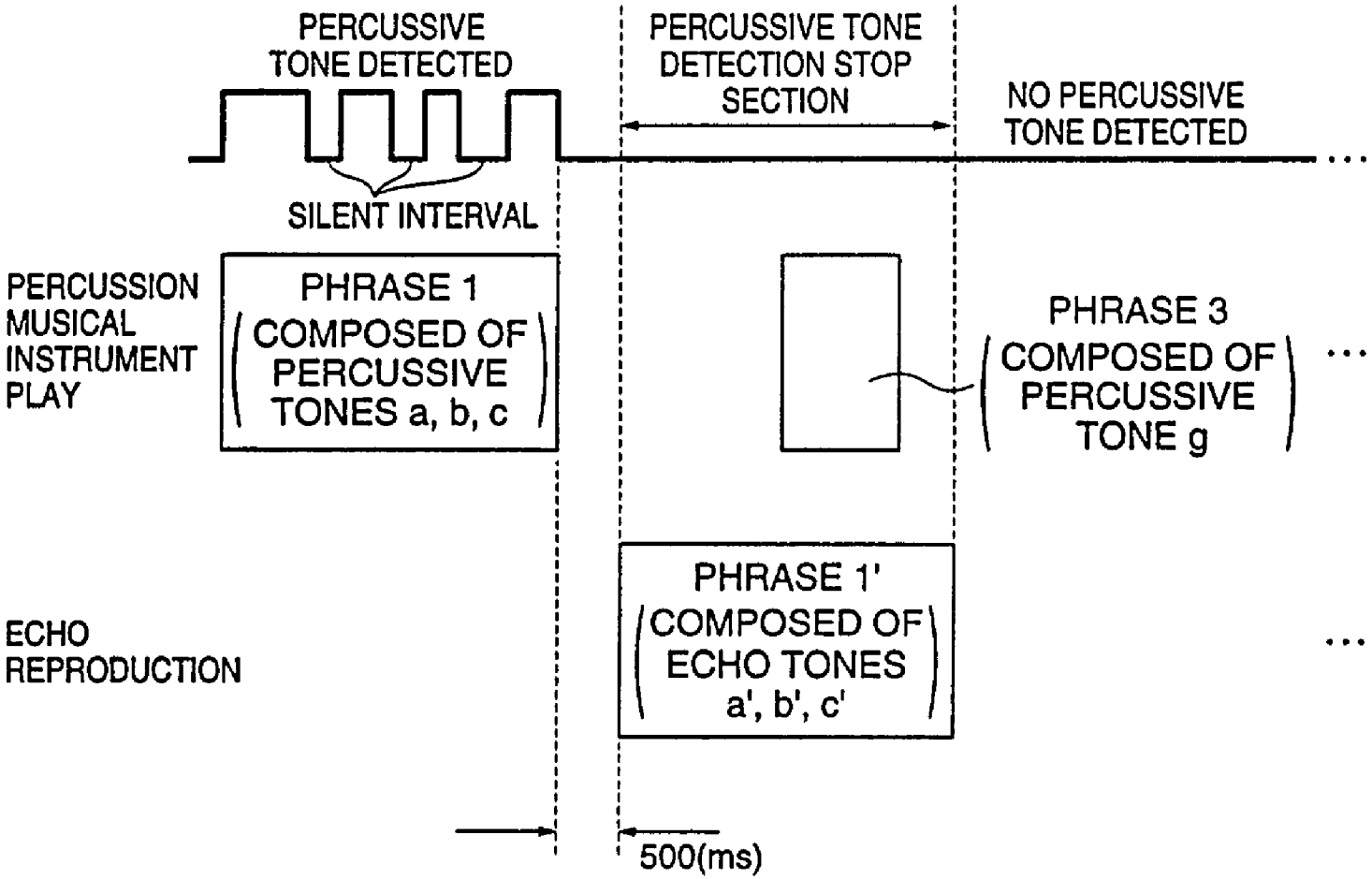
FIG. 11 is a view useful in explaining an echo reproducing process according to a second variation of the first embodiment.

Further, although the above described echo reproducing apparatus 300 is configured to start reproducing an echo tone and restart detecting a percussive tone sounded from the percussion musical instrument 200 at the same time as shown in FIGS. 8 and 9, the echo reproducing apparatus 300 may stop detecting the percussive tone sounded from the percussion musical instrument 200 until the reproduction of the echo tone is completed after the reproduction of the echo tone is started (refer to a percussive tone detection stop interval in FIG. 11). Therefore, the user can make performance while superimposing his or her performance tones (i.e. percussive tones sounded form the percussion musical instrument 200 according to the operation by the user) over echo tones sounded from the echo reproducing apparatus 300.

Further, although in the above described embodiment, the echo reproducing apparatus 300 is configured to select the tone color of the percussion musical instrument 200 through the operation of the operating section 350 by the player, this is not limitative, but the tone color selecting means 323 may automatically select the tone color of the percussion musical instrument 200 by registering waveform data representing characteristics of tone colors (IDs) in the tone color management table TA, and comparing the waveform data with the signal waveform of the electric signal supplied from the microphone 310.

In further detail, the tone color selecting means 323 compares the electric signal supplied from the microphone 310 with the waveform data registered in the tone color management table TA, and reads out an ID, registered correspondingly to waveform data representing a waveform closest to the signal waveform of the electric signal, from the tone color management table TA and stores the same in the memory 323*a*. In response to an ID transfer request from the MIDI data generating means 324, the tone color selecting means 323 supplies the ID stored in the memory 323*a* to the MIDI data generating means 324. Thus, the tone color selecting means 323 automatically selects the tone color of the percussion musical instrument 200.

Further, although the above described echo reproducing apparatus 300 is configured to generate MIDI data based on percussive tones sounded from the percussion musical instrument 200 and to sound echo tones by reproducing the MIDI data, there is no intention to limit the invention to this. For example, the echo reproducing apparatus 300 may be provided with an effect sound generating means for generating a variety of effect sounds such as clap sound, wave sound, wind sound, and female vocal so as to generate effect sounds in timing in which echo sounds are generated. It should be noted that the player may arbitrarily select effect sounds to be generated, but the effect sound generating means may count the number of times effect sounds are generated so that effect sounds may be automatically selected according to the counted number of times. Further, the effect sound generating means may be provided with a memory, not shown, that stores MIDI data used to generate respective effect sounds, and then there is no necessity of providing the MIDI data generating means 324 in FIG. 4 to simplify the echo reproducing apparatus 300.

Further, without generating new MIDI data from percussive tones sounded from the percussion musical instrument 200, waveform data corresponding to the percussive tones may be directly recorded to reproduce the waveform data in timing in which echo tones are generated. It should be noted that the waveform data may be recorded by compression in MP3 (MPEG Audio Layer-3) format or the like, and may be reproduced using an MP3 encoder, not shown. As is clear from the above description, what kinds of echo tones should be generated using what kind of tone generator may be arbitrarily determined according to the configuration of the echo reproducing apparatus 300 and the like.

In the above described first embodiment, the echo reproducing apparatus 300 is applied to the natural musical instrument 200 that generates natural musical tones. A description will now be given of a second embodiment of the present invention in which the echo reproducing apparatus 300 is applied to an electronic musical instrument that generates electronic musical tones.

Figure 12:
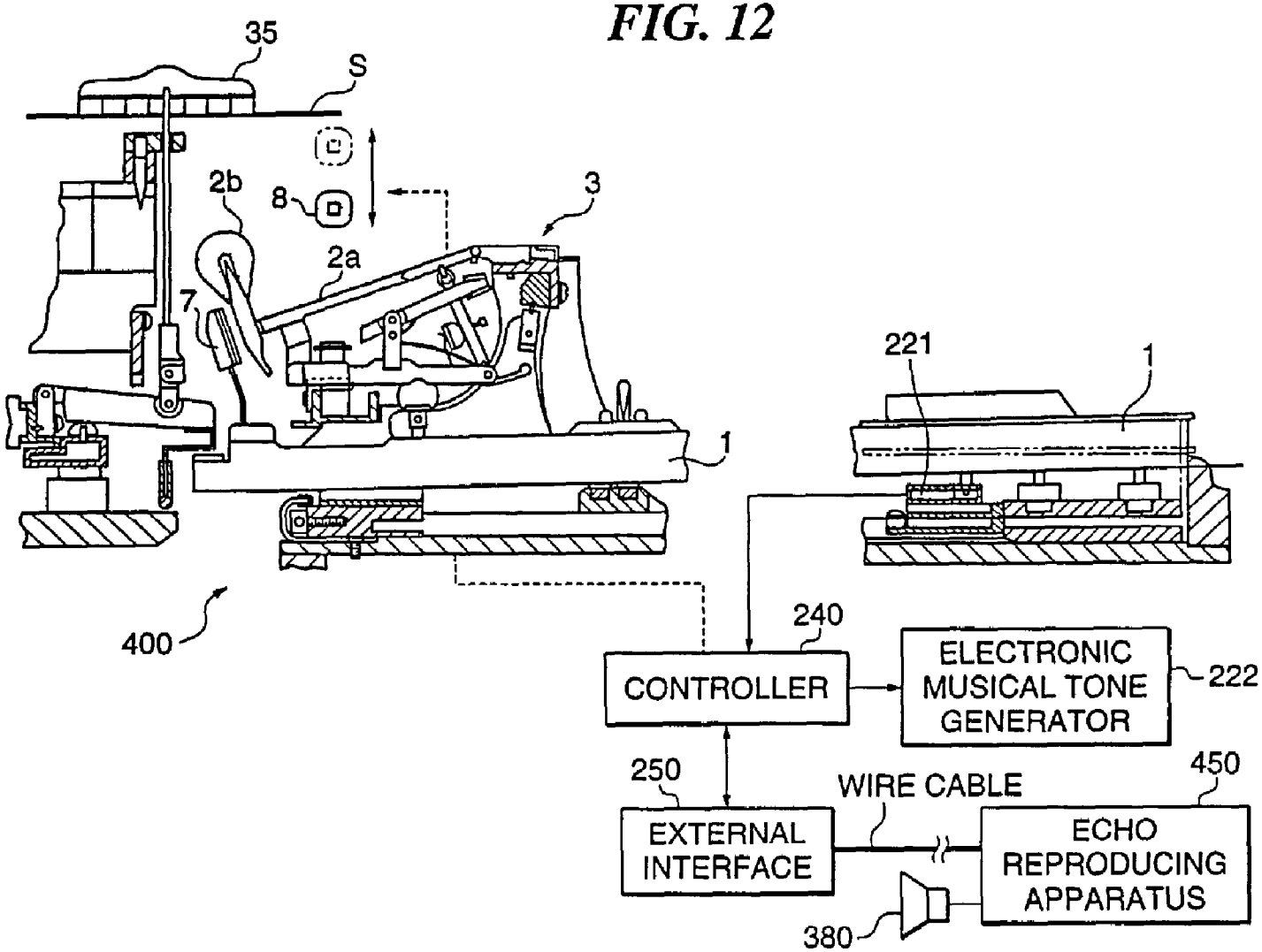
FIG. 12 is a view showing the construction of an electronic reproducing piano as a tone generating apparatus according to a second embodiment of the present invention.

As shown in FIG. 12, an electronic reproducing piano 400 is comprised of a plurality of keys 1 juxtaposed in a direction vertical to the page surface, a hammer action mechanism 3 that transmits the motions of the keys 1 to a hammer shank 2*a* and a hammer 2*b*, a string S that is hammered by the hammer 2*b*, a damper 35 that is disposed to stop the vibration of the string S, and a stopper 8 (movable in a direction indicated by an arrow in FIG. 12) that restricts the movement of the hammer 2*b*. The above construction of the electronic reproducing piano 400 is identical with that of ordinary automatic pianos. The electronic reproducing piano 400 is also comprised of a mechanism installed in ordinary acoustic pianos, such as a back check 7 that prevents the violent movement of the hammer 2*b* that is rebounded by hammering of the spring S.

The electronic reproducing piano 400 is comprised of a controller 240 that controls the overall operations of the electronic reproducing piano 400, an electronic musical tone generator 222 that generates electronic musical tones based on a control signal outputted from a key sensor 221, an external device interface 250, a storage device, not shown, that stores performance data and the like, and is connected to an echo reproducing apparatus 450 via a wire cable conforming to the IEEE1394 (Institute of Electrical and Electronic Engineers 1394) standards, the RS232C (Recommended Standard 232 Version C) standards, or the like. It should be noted that the present embodiment assumes that the electronic reproducing piano 400 and the echo reproducing apparatus 450 are connected to each other via the wire cable, but they may be radio-connected to each other (e.g. IEEE 802.11b, Bluetooth, White Cap, IEEE802.11a, Wireless 1394, or IrDA).

The controller 240 generates a control signal for generation of electronic musical tones based on the signal supplied from the key sensor 221, and supplies the control signal to the electronic musical tone generator 222 and to the echo reproducing apparatus 450 via a wire cable connected to the external device interface 250. When generating electronic musical tones according to the operation of the keys 1, the controller 240 also provides control to inhibit the hammer 2*b* from hammering the string S by controlling the position of the stopper 8 so as to inhibit sounding caused by hammering.

The key sensor 221 is comprised of a plurality of sensors each disposed at a location corresponding to the lower surface of a corresponding one of the keys 1, and each output a signal corresponding to a change in the state of the corresponding key 1 (key depression, key release, etc.) to the controller 240.

The electronic musical tone generator 222 is comprised of a tone generator, a speaker, and the like, and generates musical tones based on the control signal supplied from the controller 240.

The echo reproducing apparatus 450 is provided with a communication interface, not shown, for providing interface for connecting with the electronic reproducing piano 400 in place of the microphone 310 of the echo reproducing apparatus 300 in FIG. 2.

Figure 13:
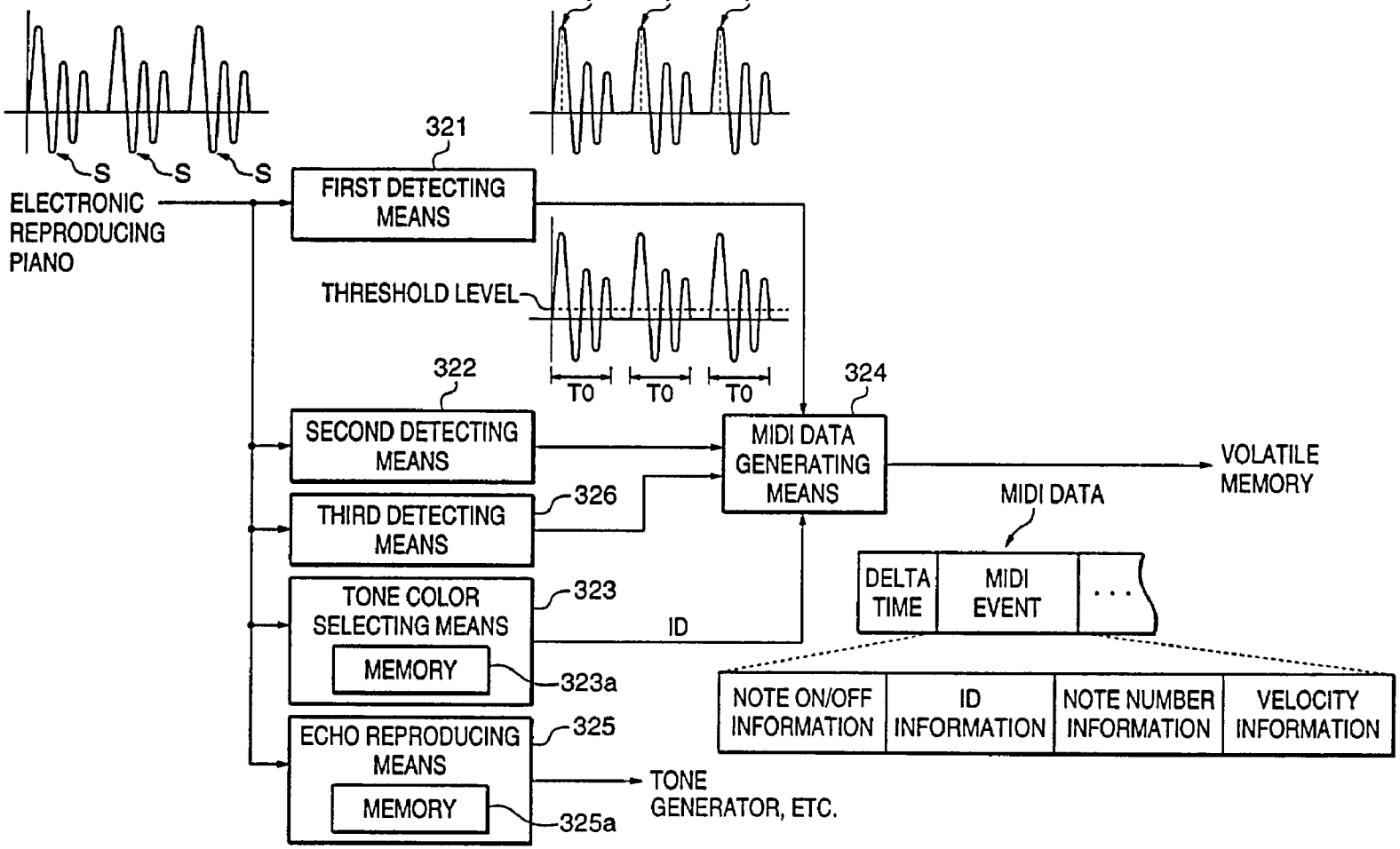
FIG. 13 is a view showing the functional arrangement of a CPU in an echo reproducing apparatus in FIG. 12.

FIG. 13 is a view showing the functional arrangement of the CPU in the echo reproducing apparatus 450 in FIG. 12.

A first detecting means 321 is for detecting the velocity of an electronic musical tone generated from the electronic musical tone generator 222. The first detecting means 321 detects a peak value p or the like of a control signal S that is supplied from the electronic reproducing piano 400 via the wire cable, and outputs the detection result to a MIDI data generating means 324.

A second detecting means 322 is for detecting the length of a percussive tone generated from the electronic musical tone generator 222. The second detecting means 322 detects a period of time T0 in which the level of the electric signal S outputted from the electronic reproducing piano 400 is in excess of a threshold, and outputs the detection result to the MIDI data generating means 324.

A third detecting means 326 is for detecting the pitch (note number) of an electronic musical tone generated from the electronic musical tone generator 222. The third detecting means 326 detects the pitch from a waveform pattern of the control signal S supplied from the electronic reproducing piano 400 via the wire cable, and outputs the detection result to the MIDI data generating means 324.

A tone color selecting means 323 is for selecting the type of electronic musical tones generated from the electronic musical tone generator 222. By referring to a tone color management table TA (refer to FIG. 3), the tone color selecting means 323 reads out an ID corresponding to tone color information (e.g. piano) contained in the control signal S supplied from the electronic reproducing piano 400 via the wire cable, from the tone color management table TA, and stores the ID in a memory 323*a*. If the control signal supplied from the electronic reproducing piano 400 contains the tone color information as mentioned above, the tone color selecting means 323 may automatically select the tone color of the electronic reproducing piano 400, but as is the case with the above described first embodiment, the tone color of the electronic reproducing piano 400 may be selected according to the operation of the operating section 350 or the like operated by the player.

The MIDI data generating means 324 generates MIDI data corresponding to the electronic musical tone based on the detection results supplied from the first detecting means 321, the second detecting means 322, and the third detecting means 326 and the ID supplied from the tone color selecting means 323. A MIDI event generated by the MIDI data generating means 324 is comprised of note-on/note-off information indicative of whether a tone should be sounded or not, ID information specifying the tone color of an echo tone, pitch information representing the pitch, and velocity information indicative of the velocity of a tone to be sounded. Specifically, the MIDI data is comprised of instructions such as "sound (note-on) a tone at do (note number) with an intensity 10 (velocity) in a drum tone color (ID)".

An echo reproducing means 325 is for carrying out the above described echo reproducing process. The echo reproducing means 325 detects the start and stop of sounding by the electronic musical tone generator 222 according to the electric signal outputted from the electronic reproducing piano 400. In a case where the stop of sounding by the electronic musical tone generator 222 is detected, the echo reproducing means 325 shifts the MIDI data stored in a recording area 341 to a reproducing area 342, and supplies the MIDI data sequentially to a tone generator 370 to carry out echo reproduction (refer to FIGS. 8 and 9). The details of the echo reproducing process are substantially the same as those of the echo reproducing process of the above described first embodiment, and a description thereof is omitted herein.

As described above, the echo reproducing apparatus 450 according to the second embodiment achieves the same effects as the echo reproducing apparatus 300 according to the above described first embodiment, and eliminates the necessity of providing a microphone or the like for use in directly detecting an electronic musical tone sounded from the electronic reproducing piano 400 because the start and stop of sounding by the electronic musical tone generator 222 are detected according to the electric signal outputted from the electronic reproducing piano 400.

It should understood that there is no intention to limit the present invention to the embodiment disclosed, but the present invention may cover all variations as described hereinbelow.

Although in the above described second embodiment, the electronic reproducing piano is given as an example of electronic musical instruments that generate electronic musical tones according to the operation by the player, the present invention may be applied to all kinds of electronic musical instruments that are capable of generating electronic musical tones, such as pianos that are capable of generating electronic musical tones and natural musical tones by hammering (i.e. automatic pianos), electronic violins, and electronic saxophones. Electronic musical tones sounded from those electronic musical instruments may be detected based on a control signal outputted from a controller of each electronic musical instrument as is the case with the second embodiment, but as is the case with the first embodiment, the echo reproducing apparatus 450 may be provided with a microphone that detects the electronic musical tones.

Further, although in the above described second embodiment, the electronic reproducing piano 400 and the echo reproducing apparatus 450 are configured in separate bodies, this is not limitative, but they may be configured as an integral unit. If they are configured as an integral unit, the performance mode of the electronic reproducing piano 400 includes a normal mode in which only electronic musical tones are generated according to the operation of the keys 1, and an echo reproduction mode in which electronic musical tones and echo tones corresponding thereto are generated according to the operation of the key 1, and the mode is switched between the normal mode and the echo reproduction mode according to the operation of the operating section 350 or the like. In further detail, when practicing the electronic reproducing piano 400, the player selects the performance mode according to the type of a musical composition intended for practice (e.g. a musical composition intended mainly for session) or the like. The performance mode may be switched between the normal mode and the echo reproduction mode according to the operation of the operating section 350 or the like. It goes without saying that the above described changes and modifications according to the first embodiment may be also applied to the second embodiment.

In the above described first and second embodiments, an echo reproducing apparatus is applied to a musical instrument which is capable of generating natural musical tones or electronic musical tones. A description will now be given of a third embodiment of the present invention in which an echo reproducing apparatus is applied to a musical tone generation control system that is capable of musical tone generation or the like in a manner reflecting motion of a user carrying an operating terminal (described later in detail).

Figure 14:
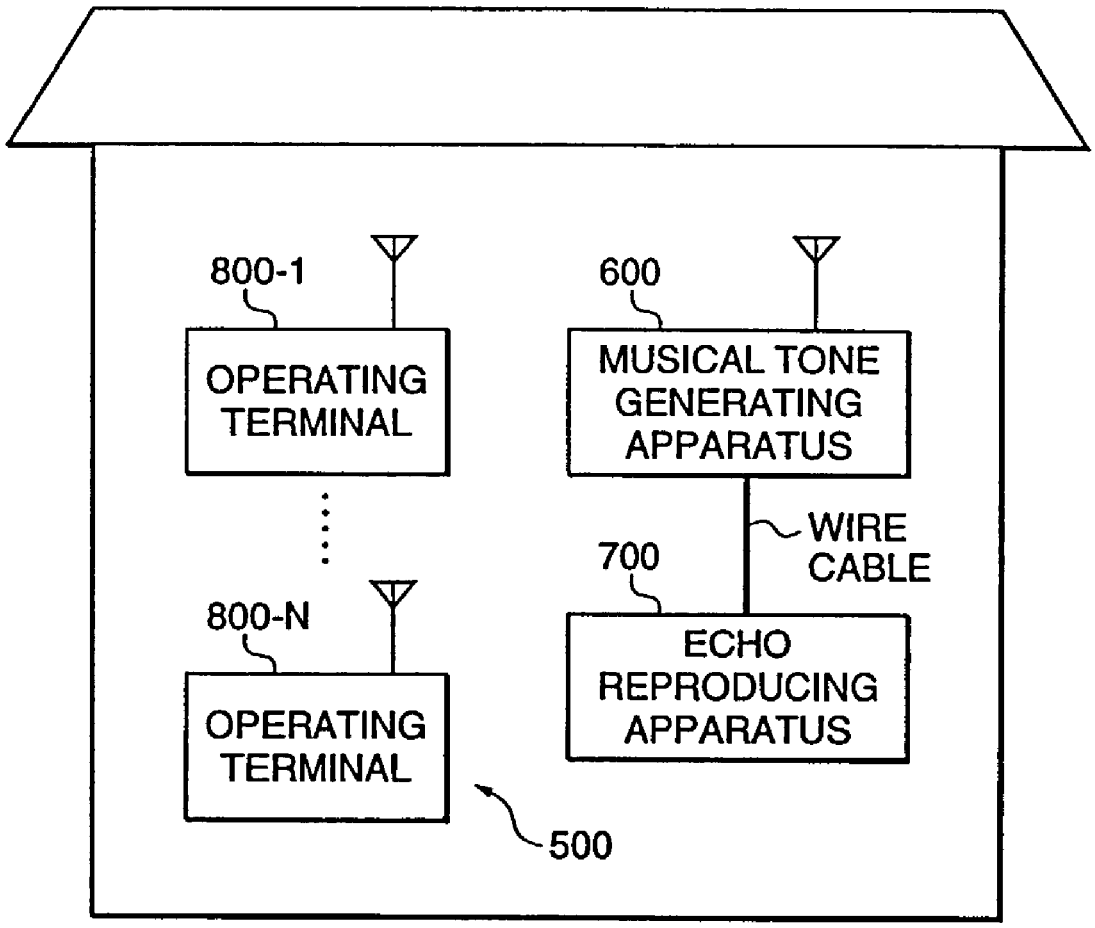
FIG. 14 is a view showing the arrangement of a musical tone generation control system including an echo reproducing apparatus as a tone generating apparatus according to a third embodiment of the present invention.

FIG. 14 is a view showing the entire construction of the musical tone generation control system according to the third embodiment of the present invention.

The musical tone generation control system 500 is used in music schools, schools in general, homes, halls, and the like, and is comprised of a musical tone generating apparatus 600, an echo reproducing apparatus 700 connected to the musical tone generating apparatus 600 via a wire cable or the like, and a plurality of operating terminals 800-N ($N \geqq 1$) provided for the musical tone generating apparatus 600.

The musical tone generation control system 500 according to the present embodiment enables users at various locations to manage musical tone generation and performance reproduction (hereinafter referred to as "the musical tone generation and the like") carried out by the musical tone generating apparatus 600. A detailed description will now be given of component parts of the musical tone generation control system 500.

Figure 15:
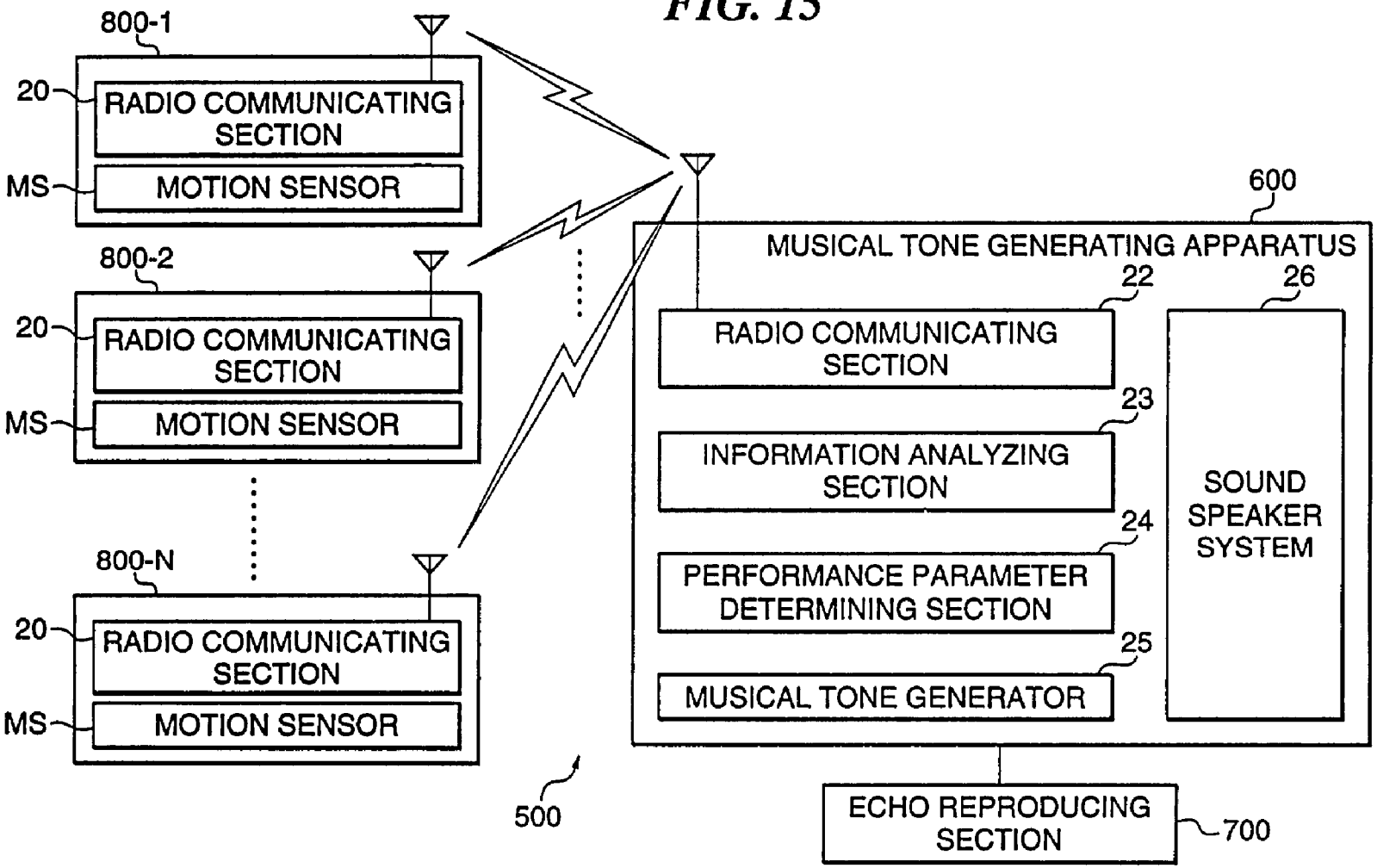
FIG. 15 is a view showing the functional arrangement of the musical tone generation control system in FIG. 14.

FIG. 15 is a view showing the functional arrangement of the musical tone generation control system in FIG. 14. In the following description, the operating terminals 800-1 to 800-N will be collectively referred to as "the operating terminal 800" if there is no necessity of distinguishing between them.

Figure 16:
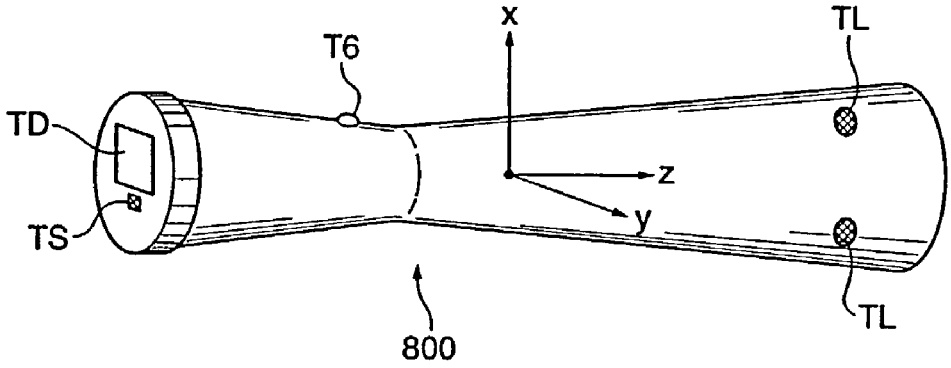
FIG. 16 is a view showing the appearance of an operating terminal in FIG. 14

The operating terminal 800 is adapted to be carried by an operator, for example, is designed to be held by the operator, or is worn on a part of the human body (refer to FIG. 16).

A motion sensor MS generates motion information by detecting a motion of the operator who is carrying the operating terminal 800, and sequentially outputs the motion information to a radio communicating section 20. A variety of known sensors such as a three-dimensional acceleration sensor, a three-dimensional velocity sensor, a two-dimensional acceleration sensor, a two-dimensional velocity sensor, and a strain sensor may be used as the motion sensor MS.

The radio communicating section 20 carries out radio-communication of data between the operating terminal 800 and the musical tone generating apparatus 600. Upon receipt of the motion information corresponding to the motion of the operator from the motion sensor MS, the radio communicating section 20 radio-transmits the motion information together with an ID for identifying the operating terminal 800 assigned thereto to the musical tone generating apparatus 600, and receives various information transmitted from the musical tone generating apparatus 600 to the operating terminal 800.

The musical tone generating apparatus 600 carries out the musical tone generation and the like according to the motion information transmitted from the operating terminal 800.

A radio communicating section 22 receives the motion information radio-transmitted from the operating terminal 800, and outputs the received motion information to an information analyzing section 23.

The information analyzing section 23 carries out predetermined analysis of the motion information supplied from the radio communicating section 22, and outputs the analysis result to a performance parameter determining section 24.

The performance parameter determining section 24 determines performance parameters such as volume and tempo of musical tones according to the motion information analysis result supplied from the information analyzing section 23.

Upon receipt of musical composition data based on the performance parameters determined by the performance parameter determining section 24, a musical tone generator 25 generates performance data based on the musical composition data and outputs the generated performance data to a sound speaker system 26. The sound speaker system 26 generates a musical tone signal from the received performance data to carry out the musical tone generation and the like, and outputs the generated musical tone signal to an echo reproducing apparatus 700. With reference to the musical tone signal supplied from the sound speaker system 26, the echo reproducing apparatus 700 detects the start and stop of sounding by the musical tone generating apparatus 600 to carry out reproduction of echo tones and the like.

A description will now be given of the arrangement of the operating terminal 800 and the musical tone generating apparatus 600, which is intended to achieve the above described functions.

As shown in FIG. 16, the operating terminal 800 according to the present embodiment is a hand-held operating terminal that is held by the operator, and is comprised of a base portion (at the left in FIG. 16) and an end portion (at the right in FIG. 16) and is tapered such that the diameter decreases away from both ends toward the central part thereof.

The base portion of the operating terminal 800 has a smaller mean diameter than the end portion so that it can be easily held by a hand, and functions as a holding section. An LED (Light Emitting Diode) display TD and a battery power switch TS are provided on an outer surface at the bottom (the left end in FIG. 16) of the base portion, and an operating switch T6 is provided on an outer surface at the center of the base portion. On the other hand, a plurality of LED emitters TL are provided in the vicinity of the leading end of the end portion. The operating terminal 800 thus configured has a variety of devices incorporated therein.

Figure 17:
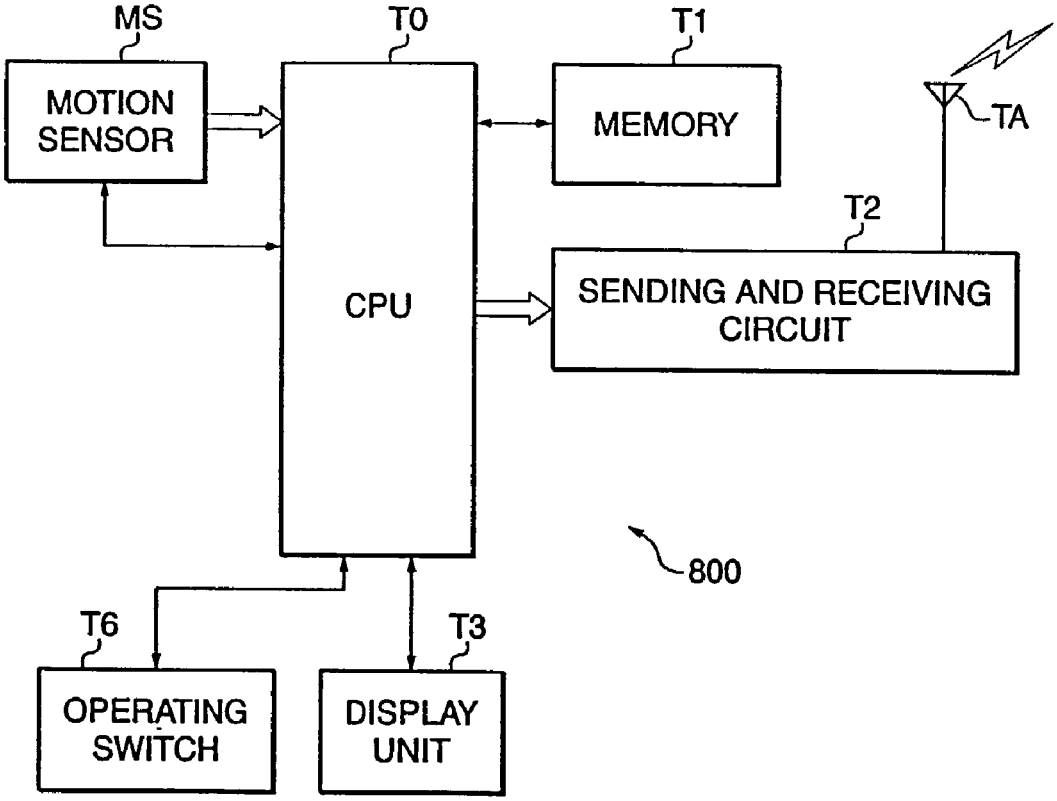
FIG. 17 is a block diagram showing the internal arrangement of the operating terminal in FIG. 14.

FIG. 17 is a block diagram showing the internal configuration of the operating terminal 800 in FIG. 14.

A CPU (Central Processing Unit) T0 controls the operations of the component parts of the operating terminal 800 such as the motion sensor MS according to a variety of control programs stored in a memory T1 (e.g. a ROM or a RAM). The CPU T0 has a function of assigning an ID for identifying the operating terminal to the motion information transmitted from the motion sensor MS, and other functions.

A three-dimensional acceleration sensor or the like is used as the motion sensor MS, which outputs the motion information according to the direction, magnitude, and velocity of motion of the operator carrying the operating terminal 800 by the hand. Although in the present embodiment, the motion sensor MS is incorporated in the operating terminal 800, the motion sensor MS may be attachable to the human body at an arbitrary portion thereof.

A sending and receiving circuit T2 is comprised of a high-frequency transmitter and a power amplifier, neither of which is shown, as well as an antenna TA, and has a function of transmitting the motion information together with the ID assigned thereto supplied from the CPU T0 to the musical tone generating apparatus 600, and other functions. Namely, the sending and receiving circuit T2 realizes the functions of the radio communicating section 20 shown in FIG. 15.

A display unit T3 is comprised of the LED display TD and the plurality of LED emitters TL mentioned above, and displays a variety of information indicative of the sensor number, operation on/off state, and power alarm, and the like. The operating switch T6 is used for turning the power of the operating terminal 800 on and off, setting the mode, and other settings. These component parts of the operating terminal 800 are supplied with drive power from a battery power unit, not shown. As this battery power unit, it is possible to use a primary cell or to use a rechargeable secondary cell.

Figure 18:
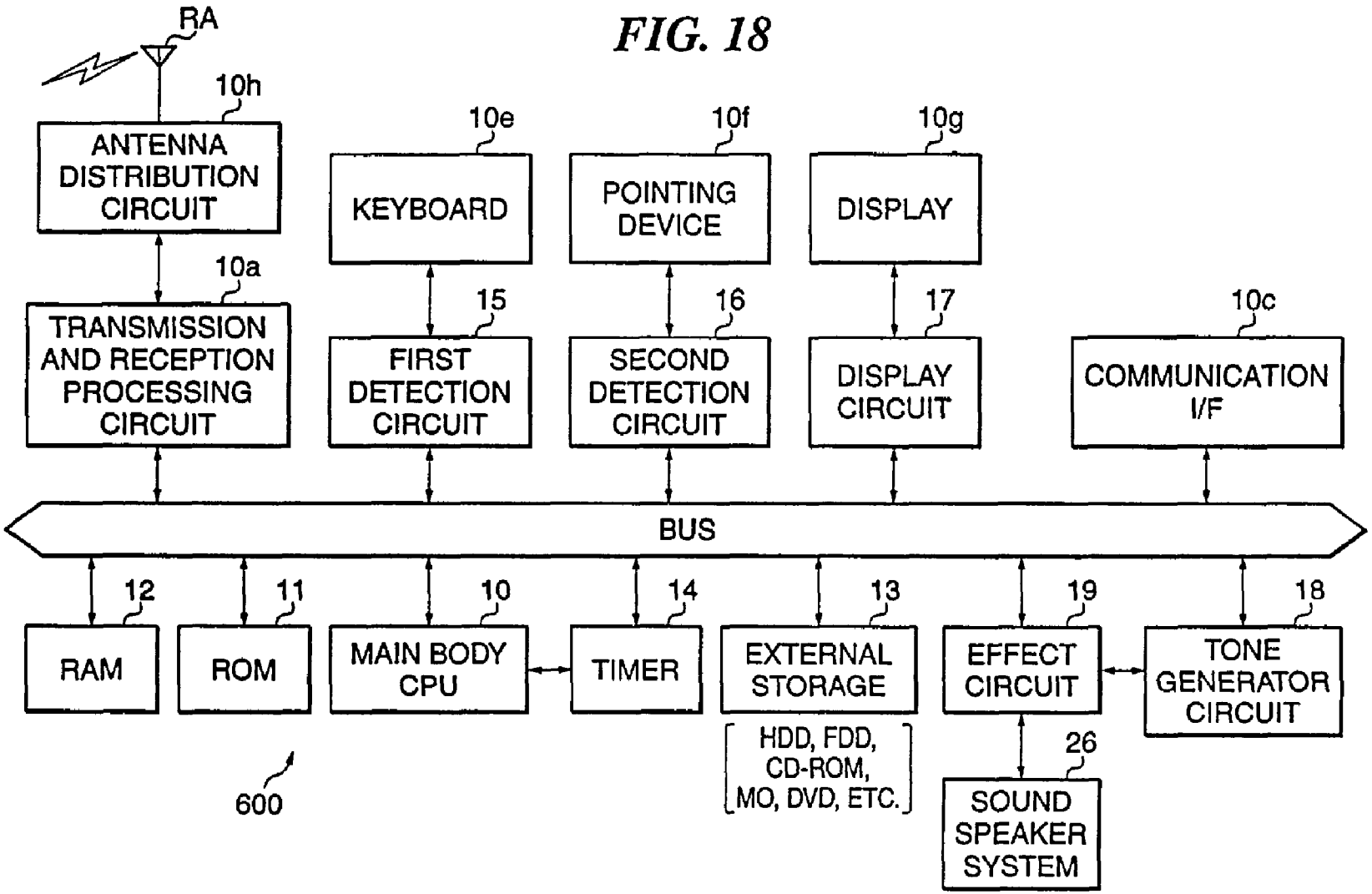
FIG. 18 is a block diagram showing the arrangement of a musical tone generating apparatus in FIG. 14.

FIG. 18 is a block diagram showing the construction of the musical tone generating apparatus in FIG. 14.

The musical tone generating apparatus 600 is comprised of a transmission and reception processing circuit 10*a* and an antenna distribution circuit 10*h*, and the like, which are intended for radio communication with the sound speaker system 26 and the operating terminal 800 and installed in an ordinary personal computer (hereinafter referred to as "PC").

A main body CPU 10 that controls the operations of component parts of the musical tone generating apparatus 600, and provides control according to predetermined programs under the time management of a timer 14 used for generation of a tempo clock, an interrupt clock, or the like to centrally execute programs such as a performance processing program related to determination of performance parameters, modifications of performance data, and control of reproduction. A ROM (Read Only Memory) 11 stores predetermined control programs for controlling the musical tone generating apparatus 600. The control programs include the performance processing program related to determination of performance parameters, modifications of performance data, and control of reproduction, a variety of data and tables, and the like. A RAM (Random Access Memory) 12 stores data and parameters required for the execution of the control programs, and serves as a work area that temporarily stores a variety of data during the execution of the control programs.

A keyboard 10*e* is connected to a first detecting circuit 15, a pointing device 10*f* such as a mouse is connected to a second detecting circuit 16, and a display 10*g* is connected to a display circuit 17. With this arrangement, the player can make various settings such as setting of modes required for control of performance data, assignment of processing and functions corresponding to the ID identifying the operating terminal 800, setting of tone color (tone generator) to a performance track by operating the keyboard 10*e* and the pointing device 10*f* while watching various screens displayed on the display 10*g*.

The antenna distribution circuit 10*h* is connected to the transmission and reception processing circuit 10*a*. The antenna distribution circuit 10*h* is comprised of a multi-channel high-frequency receiver, for example, and receives the motion information radio-transmitted from the operating terminal 800 via an antenna RA. The transmission and reception processing circuit 10*a* performs predetermined signal processing on a signal received from the operating terminal 800. Namely, the transmission and reception processing circuit 10*a* and the antenna distribution circuit 10*h* constitute the radio communicating section 22 in FIG. 15.

The main body CPU 10 carries out performance processing according to the above-mentioned performance processing program, and analyzes the motion information representing the motion of the body of the operator holding the operating terminal 800 to determine performance parameters according to the analysis result. Namely, the main body CPU 10 realizes the functions of the information analyzing section 23 and the performance parameter determining section 24 in FIG. 15. The analysis of the motion information, the determination of the performance parameters, and the like will be described later in further detail.

An effect circuit 19 is comprised of a DSP (Digital Signal Processor), for example, and operates in cooperation a tone generator circuit 18 and the main body CPU 10 to realize the functions of the musical tone generator 25 appearing in FIG. 15. The tone generator circuit 18, the effect circuit 19, and the like control the performance data according to the performance parameters set by the main body CPU 10 to generate performance data which has been processed according to the motion of the operator. The sound speaker system 26 generates a musical tone signal based on the processed performance data, and sounds performance musical tones. It should be noted that the tone generator circuit 18 is capable of generating musical tone signals for a number of tracks at the same time according to multi-system sequence programs.

An external storage device 13 is comprised of a storage device such as a hard disk drive (HDD), compact disk read only memory (CD-ROM), floppy disk drive (FDD), magneto-optical (MO) disk drive, or digital versatile disk (DVD) drive, and is capable of storing various control programs and various data such as musical composition data. Thus, the variety of programs such as the performance processing program required for determination of performance parameters, modifications of performance data, and control of reproduction can be read from the external storage device 13 into the RAM 12, and the ROM 11 should not necessarily be used. As the need arises, the processing result may be recorded in the external storage device 13.

Figure 19:
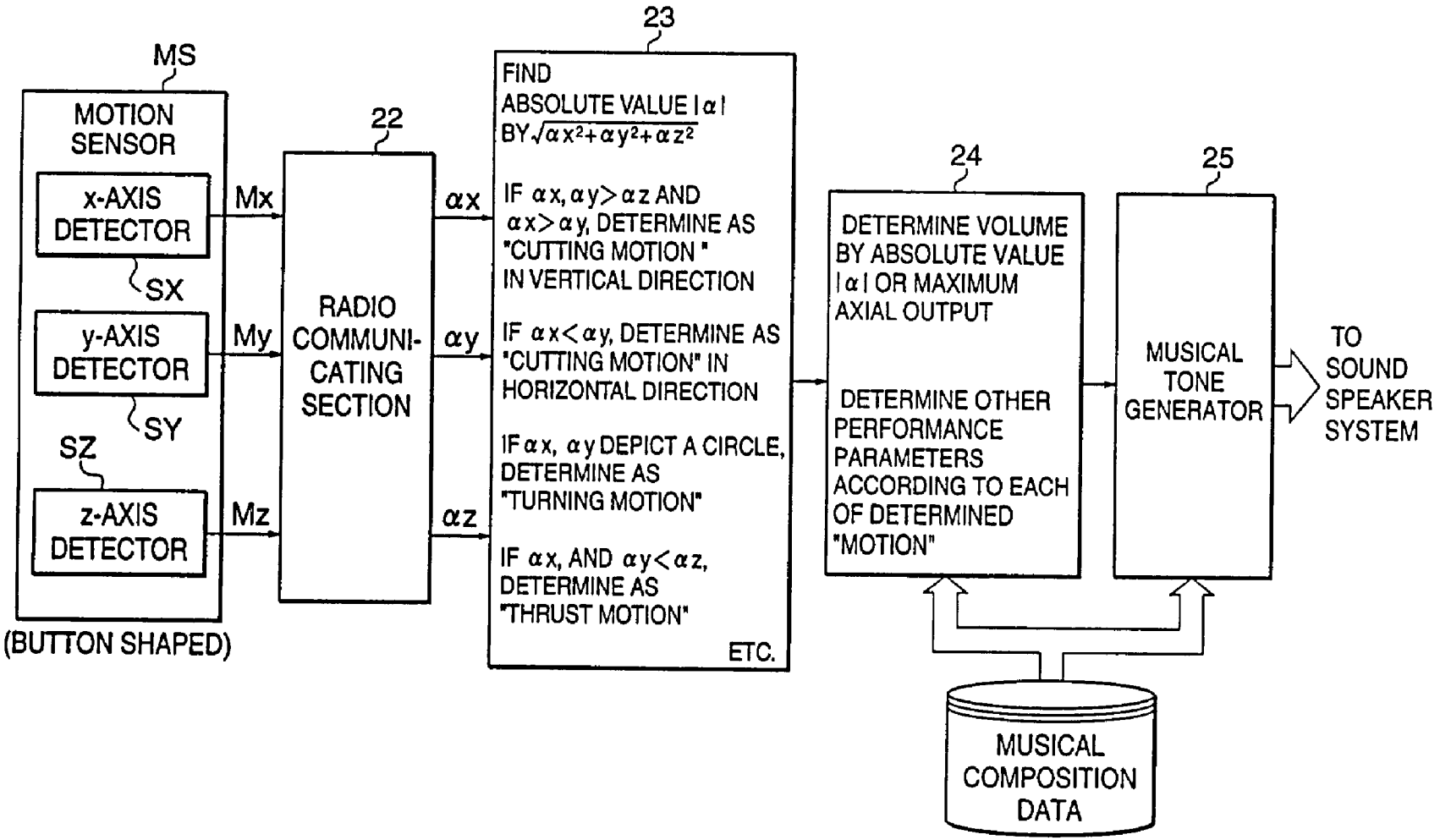
FIG. 19 is a block diagram useful in explaining the operation of the musical tone generating apparatus in FIG. 14.

Referring to FIGS. 15, 19, and other figures, a description will now be given of the motion information analyzing process and the performance parameter determining process carried out in a case where a three-dimensional acceleration sensor is used as the motion sensor MS.

FIG. 19 is a block diagram useful in explaining the operation of the musical tone generating apparatus in FIG. 14.

In response to operation of the operating terminal 800 having the motion sensor MS incorporated therein by the operator holding the operating terminal 800, motion information corresponding to the operating direction and the operating force is transmitted from the operating terminal 800 to the musical tone generating apparatus 600. In further detail, signals Mx, My, and Mz representing an acceleration $\alpha x$ ("x" is a subscript) in the direction of an x-direction x (vertical), an acceleration $\alpha y$ ("y" is a subscript) in a y-direction (vertical to the page surface of FIG. 16), and an acceleration $\alpha z$ ("z" is a subscript) in a z-direction (parallel to the page surface of FIG. 16), respectively are outputted from an x-axis detector SX, a y-axis detector SY, and a z-axis detector SZ in the motion sensor MS of the operating terminal 800, and the CPU T0 radio-transmits the signals Mx, My, and Mz with respective IDs assigned thereto as motion information to the musical tone generating apparatus 600. The radio communicating section 22 refers to a table, not shown, to compare the IDs assigned to the received motion information with IDs registered in the table. After checking that the same IDs as the IDs assigned to the motion information are registered in the table, the radio communicating section 22 outputs the motion information as acceleration data $\alpha x$, $\alpha y$, and $\alpha z$ to the information analyzing section 23.

The information analyzing section 23 analyzes data on the acceleration in the direction of each axis to find an absolute value $|\alpha|$ of the acceleration represented by the following expression (1):

$$|\alpha|=(\alpha x*\alpha x+\alpha y*\alpha y+\alpha z*\alpha z)^{1/2} \quad (1)$$

The information analyzing section 23 then compares the accelerations $\alpha x$ and $\alpha y$ with the acceleration $\alpha z$. If the comparison result shows the following relationship (2), that is, if the acceleration $\alpha z$ in the z-direction is greater than the accelerations $\alpha x$ and $\alpha y$, the information analyzing section 23 determines that the motion is a "thrust motion" in which the operation terminal 800 is thrusted:

$$\alpha x<\alpha z \text{ and } \alpha y<\alpha z \quad (2)$$

Conversely, if the acceleration $\alpha z$ in the z-direction is smaller than the accelerations $\alpha x$ and $\alpha y$, the information analyzing section 23 determines that the motion is a "cutting motion" in which the air is cut by the operation terminal 800. In this case, by comparing the values of the accelerations $\alpha x$ and $\alpha y$ in the x- and y-directions, the information analyzing section 23 can determine whether the "cutting motion" is performed in the vertical direction (x-direction) or the horizontal direction (y-direction).

By not only comparing the components in the direction of the axes x, y, and z with each other but also comparing the magnitude of the components $\alpha x$, $\alpha y$, and $\alpha z$ themselves with respective predetermined thresholds, the information analyzing section 23 can determine that the motion is a "combined motion" in which the above-described motions are combined if the components $\alpha x$, $\alpha y$, and $\alpha z$ are equal to or greater than the predetermined threshold. For example, if $\alpha z>\alpha x$, $\alpha z>\alpha y$, and $\alpha x>$"the threshold of the x component", the information analyzing section 23 determines that the motion is a "motion in which the operating terminal 800 is thrusted while the air is cut in the vertical direction (x-direction)", and if $\alpha z<\alpha x$, $\alpha z<\alpha y$, $\alpha x>$"the threshold of the x component", and $\alpha y>$"the threshold of the y component", the information analyzing section 23 determines that the motion is a "motion in which the air is cut by the operating terminal 800 in a diagonal direction (x- and y-directions)". Further, by detecting a phenomenon that the values of the accelerations $\alpha y$ in the x-direction and the y-direction are changed in such a way as to describe a circle, the information analyzing section 23 can determine that the motion is a "turning motion" in which the operating terminal 800 is turned round.

The performance parameter determining section 24 determines a variety of performance parameters corresponding to the musical composition data according to the determination results obtained by the analyzing process carried out by the information analyzing section 23. For example, the performance parameter determining section 24 controls the volume with which the performance data is reproduced according to the absolute value $|\alpha|$ of the acceleration and the magnitude of the maximum component among the components $\alpha x$, $\alpha y$, and $\alpha z$.

The performance parameter determining section 24 also controls other parameters according to the determination results. For example, the performance parameter determining section 24 controls the tempo according to the cycle of the "vertical (x-direction) cutting motion". On the other hand, if it is determined that the "vertical cutting motion" is quick and small, the performance parameter determining section 24 provides an articulation such as an accent, and if it is determined that the "vertical cutting motion" is slow and wide, the performance parameter determining section 24 lowers the pitch. If it is determined that the motion is the "horizontal (y-direction) cutting motion", the performance parameter determining section 24 provides a slur effect, and if it is determined that the motion is the "thrust motion", the performance parameter determining section 24 provides a staccato effect in the timing of the thrust motion by reducing the musical tone generation period, and inserts a single tone (e.g. a percussion musical instrument tone or a hoy) according to the magnitude of the thrust motion into musical tones being generated. Further, if it is determined that the motion is a combination of the "horizontal (y-direction) cutting motion" and the "thrust motion", the performance parameter determining section 24 provides the above-described two kinds of control, and if it is determined that the motion is the "turning motion", the performance parameter determining section 24 provides control so as to raise the reverberation effect if the cycle is long, and to generate a trill if the cycle is short. These types of control are only an example, and the present invention should not be limited to this. For example, the performance parameter determining section 24 may control the dynamics according to a local peak value of the acceleration in the direction of each axis, and control the articulation according to a peak value Q representing the sharpness of a local peak.

Once the performance parameter determining section 24 has determined the performance parameters, the musical composition data based on the performance parameters are outputted to the musical composition generating section 25.

The musical tone generator 25 generates performance data according to the musical composition data supplied from the performance parameter determining section 24, and outputs the performance data to the sound speaker system 26. The sound speaker system 26 generates a musical tone signal from the performance data to carry out the musical tone generation and the like, and outputs the generated musical tone signal to the echo reproducing apparatus 700. According to the musical tone signal supplied from the sound speaker system 26, the echo reproducing apparatus 700 detects the start and stop of sounding by the musical tone generating apparatus 600 to carry out the echo tone reproduction and the like. With this arrangement, the musical tone generating apparatus 600 carries out generation of musical tones and the like in a manner reflecting motion of the operator carrying the operating terminal 800, and upon the lapse of a predetermined period of time after the generation of the musical tones (i.e. upon the lapse of the sounding detection time), echo tones corresponding to the musical tones are generated, so that one operator can perform a session or the like as is the case with the above described embodiments.

A description will now be given of the operation of the present embodiment in a case where the operator controls performance reproduction by operating the operating terminal 800 so as to make the "horizontal (y-direction) cutting motion" and generate a single tone.

If the operator shakes the operating terminal 800 from side to side with the mounting position of the operating switch T6 facing upward after he or she applies power to the musical tone generating apparatus 600 by operating the operating switch T6 of the operating terminal 800, the keyboard 10*e* of the musical tone generating apparatus 600, or the like, a signal representing the acceleration $\alpha y$ in the y-direction corresponding to the acceleration in shaking is generated and transmitted as motion information to the musical tone generating apparatus 600.

Upon receipt of the motion information from the operating terminal 800, the radio communicating section 22 of the musical tone generating apparatus 600 supplies the motion information as acceleration data to the information analyzing section 23. The information analyzing section 23 analyzes the received acceleration data, and if determining that the motion is the "horizontal (y-direction) cutting motion", the information analyzing section 23 outputs the determination result and information on the cycle of the "horizontal (y-direction) cutting motion" to the performance parameter determining section 24.

If determining that the motion is the "horizontal (y-direction) cutting motion" based on the determination result obtained by the information analyzing section 23 and the like, the performance parameter determining section 24 generates single tone information relating to a single tone to be generated (e.g. type information on the type of a single tone, volume information representing the volume of a single tone, and timing information on the timing for generating a single tone), and outputs the generated single tone information as musical composition data to the musical tone generator 25. The musical tone generator 25 generates performance data according to the received musical composition data, and outputs the performance data to the sound speaker system 26. The sound speaker system 26 generates a musical tone signal from the performance data to carry out generation of musical tones and the like, and outputs the generated musical tone signal to the echo reproducing apparatus 700. According to the musical tone signal supplied from the sound speaker system 26, the echo reproducing apparatus 700 detects the start and stop of sounding by the musical tone generating apparatus 600 to carry out echo tone reproduction and the like. It should be noted that the operation of the echo reproducing apparatus 700 is identical with that of the above described first and second embodiments, and a description thereof is omitted herein.

As described above, according to the musical tone generation control system 500 of the present embodiment, the musical tone generating apparatus 600 carries out generation of musical tones and the like in a manner reflecting motion of the operator carrying the operating terminal 800, and upon the lapse of a predetermined period of time after the generation of the musical tones (i.e. upon the lapse of the sounding detection time), echo tones corresponding to the musical tones are generated, so that one operator can perform a session or the like as is the case with the above described embodiments. Further, the operator can recognize how his or her operation is reflected upon performance reproduction by referring to musical tones generated from the musical tone generating apparatus 600 and echo tones generated from the echo reproducing apparatus 700.

It is to be understood that the object of the present invention may also be accomplished by supplying a system or an apparatus with a program code of software which realizes the functions of the above described embodiment, and causing a computer (or CPU or MPU) of the system or apparatus to execute the supplied program code.

In this case, the program code itself realizes the novel functions of the present invention, and hence the program code and a storage medium on which the program code is stored constitute the present invention.

The program code is stored in a ROM as a storage medium. However, the storage medium for supplying the program code is not limited to a ROM, and a floppy (registered trademark) disk, a hard disk, an optical disk, a magnetic-optical disk, a CD-ROM, a CD-R, a CD-RW, a DVD-ROM, a DVD-RAM, a DVD–RW, a DVD+RW, a magnetic tape, a nonvolatile memory card, and a download performed via a network may be used.

What is claimed is:

1. A tone generating apparatus comprising:

a detecting device that detects musical tones generated from a musical instrument;

a storage device that stores tone data;

a phrase detection system that identifies a phrase from a sequence of tones by detecting a silence interval of predetermined duration and using said detected silence interval to delimit the end of said phrase;

a tone generating device that reproduces the tone data stored in said storage device and generates at least one tone corresponding to the tone data in response to said detected silence interval within a predetermined period of time after a musical tone is detected by said detecting device; and a writing device that generates tone data from the musical tones detected by said detecting device and sequentially stores the generated tone data in said storage device;

wherein said tone generating device sequentially reproduces the tone data stored in said storage device to generate a phrase corresponding to the tone data in response to said detected silence interval within a predetermined period of time after a musical tone is detected by said detecting device.

2. A tone generating apparatus according to claim 1, wherein said writing device generates tone data for generating electronic tones by modifying at least one parameter selected from the group consisting of volume, tone color, and pitch of the musical tones detected by said detecting device, and sequentially stores the generated tone data in said storage device; and wherein said tone generating device reproduces the tone data stored in said storage device to generate a phrase composed of at least one electronic tone with the at least one parameter selected from the group consisting of volume, tone color, and pitch of the musical tones detected by said detecting device being modified, when no next musical tone is detected by said detecting device within the predetermined period of time after a musical tone is detected by said detecting device.

3. A tone generating apparatus according to claim 1, wherein when a musical tone is detected by said detecting device while the phrase corresponding to the tone data is being generated, said tone generating device stops generating the phrase.

4. A tone generating apparatus according to claim 1, wherein while the phrase corresponding to the tone data is being generated by said tone generating device, said detecting device stops detection of the musical tones.

5. A tone generating apparatus according to claim 1, wherein the musical instrument is a natural musical instrument.

6. A tone generating apparatus comprising:

an acquiring device that acquires an operating condition of an operating terminal that can be carried by a user to generate a musical tone, said operating terminal having a device for detecting a motion of the operating terminal caused by an operation of the operator;

a detecting device that refers to the operating condition of the operating terminal acquired by said acquiring device to determine whether the operating terminal lies in such an operating condition as to generate a musical tone;

a storage device that stores tone data;

a phrase detection system that identifies a phrase from a sequence of tones by detecting a silence interval of predetermined duration and using said detected silence interval to delimit the end of said phrase; and a tone generating device that, after said detecting device detects an operating condition in which the operating terminal generates a musical tone, reproduces the tone data stored in said storage device to generate a tone corresponding to the tone data in response to said detected silence interval within a predetermined period of time after the detection of said detecting device, wherein said acquiring device acquires the motion of said operating terminal.

7. A tone generating apparatus according to claim 1, wherein said detecting device detects singing voices, said storage device stores singing voice data, and said tone generating device reproduces the singing voice data stored in said storage device and generates at least one tone corresponding to the singing voice data when no next singing voice is detected by said detecting device within a predetermined period of time after a singing voice is detected by said detecting device.

8. A tone generating apparatus according to claim 1, wherein the predetermined period of time can be set to a desired value by a user.

9. A tone generating apparatus according to claim 1, wherein the at least one tone corresponding to the tone data is at least one echo tone.

10. A tone generating apparatus according to claim 1, wherein the at least one tone corresponding to the tone data is at least one effect tone.

11. A tone generating method comprising the steps of:

detecting musical tones generated from a musical instrument;

storing tone data in a storage device;

identifying a phrase from a sequence of tones by detecting a silence interval of predetermined duration and using said detected silence interval to delimit the end of said phrase;

reproducing the tone data stored in the storage device and generating at least one tone corresponding to the tone data in response to said detected silence interval within a predetermined period of time after a musical tone is detected; and generating tone data from the musical tones detected and sequentially storing the generated tone data in the storage device;

wherein said reproducing step comprises sequentially reproducing the tone data stored in the storage device to generate a phrase corresponding to the tone data in response to said detected silence interval within a predetermined period of time after a musical tone is detected.

12. A tone generating method comprising the steps of:

acquiring an operating condition of an operating terminal that can be carried by a user to generate a musical tone, the operating terminal having a device for detecting a motion of the operating terminal caused by an operation of the operator;

referring to the operating condition of the acquired operating terminal to determine whether the operating terminal lies in such an operating condition as to generate a musical tone;

storing tone data in a storage device;

identifying a phrase from a sequence of tones by detecting a silence interval of predetermined duration and using said detected silence interval to delimit the end of said phrase; and reproducing, after an operating condition is detected in which the operating terminal generates a musical tone, the tone data stored in the storage device to generate a tone corresponding to the tone data in response to said detected silence interval within a predetermined period of time after the detection of the operating condition, wherein said acquiring step comprises acquiring the motion of the operating terminal.

13. A computer-readable tone generating program comprising:

a detecting module for detecting musical tones;

a storage module for storing tone data in a storage device;

a phrase detection module for identifying a phrase from a sequence of tones by detecting a silence interval of predetermined duration and using said detected silence interval to delimit the end of said phrase;

a tone generating module for reproducing the tone data stored in the storage device and generates at least one tone corresponding to the tone data in response to said detected silence interval within a predetermined period of time after a musical tone is detected by said detecting module; and a writing module for generating tone data from the musical tones detected and sequentially storing the generated tone data in the storage device;

wherein said tone generating module sequentially reproduces the tone data stored in the storage device to generate a phrase corresponding to the tone data in response to said detected silence interval within a predetermined period of time after a musical tone is detected.

14. A computer-readable tone generating program comprising:

an acquiring module for acquiring an operating condition of an operating terminal that can be carried by a user to generate a musical tone, the operating terminal having a device for detecting a motion of the operating terminal caused by an operation of the operator;

a detecting module for referring to the operating condition of the operating terminal acquired by said acquiring module to determine whether the operating terminal lies in such an operating condition as to generate a musical tone;

a storage module for storing tone data in a storage device;

a phrase detection module for identifying a phrase from a sequence of tones by detecting a silence interval of predetermined duration and using said detected silence interval to delimit the end of said phrase; and a tone generating module for, after said detecting module detects an operating condition in which the operating terminal generates a musical tone, reproducing the tone data stored in the storage device to generate a tone corresponding to the tone data in response to said detected silence interval within a predetermined period of time after the detection of said detecting module, wherein said acquiring module acquires the motion of the operating terminal.

15. A method of automatic tone generation comprising:

acquiring data representing a sequence of tones output from a tone generating device;

storing the acquired data;

identifying a phrase from said sequence of tones by detecting a silence interval of predetermined duration and using said detected silence interval to delimit the end of said phrase; and replaying said identified phrase at least one time in response to said detected silence interval by audible means.

16. The method of claim 15 wherein said acquiring data step is performed by receiving audible tones from said tone generating device.

17. The method of claim 15 wherein said phrase identifying step further includes detecting an onset of tones following a silence interval and using said detected onset to delimit the beginning of said phrase.

18. The method of claim 15 further comprising using said tone generating device to replay said identified phrase.

19. The method of claim 15 wherein said replaying step is performed by supplying data corresponding to said identified phrase to said tone generation device and using said tone generation device to replay said identified phrase.

20. The method of claim 15 further comprising receiving musical instrument manipulation information from an electronic musical instrument and using said manipulation information to generate said sequence of tones output from said tone generating device.

21. The method of claim 15 wherein said replaying step is automatically initiated in response to said step of detecting a silence interval of predetermined duration.

* * * * *